US006825816B2

(12) United States Patent
Aikawa et al.

(10) Patent No.: US 6,825,816 B2
(45) Date of Patent: Nov. 30, 2004

(54) TWO-ELEMENT AND MULTI-ELEMENT PLANAR ARRAY ANTENNAS

(75) Inventors: Masayoshi Aikawa, 26-11, Nara 2-chome, Aoba-ku, Yokohama-shi, Kanagawa (JP); Eisuke Nishiyama, Saga (JP); Fumio Asamura, Saitama (JP); Takeo Oita, Saitama (JP)

(73) Assignees: Nibon Dempa Kogyo Co., Ltd., Tokyo (JP); Masayoshi Aikawa, Kanagawa (JP)

( * ) Notice: Subject to any disclaimer, the term of this patent is extended or adjusted under 35 U.S.C. 154(b) by 75 days.

(21) Appl. No.: 10/422,465

(22) Filed: Apr. 24, 2003

(65) Prior Publication Data

US 2003/0201944 A1 Oct. 30, 2003

(30) Foreign Application Priority Data

Apr. 26, 2002 (JP) ..... 2002-127229
May 23, 2002 (JP) ..... 2002-149781

(51) Int. Cl.[7] ..... H01Q 13/10
(52) U.S. Cl. ..... 343/770; 343/700 MS
(58) Field of Search ..... 343/700 MS, 767, 343/770, 893

(56) References Cited

U.S. PATENT DOCUMENTS 3,757,344 A * 9/1973 Pereda ..... 343/770
4,792,809 A * 12/1988 Gilbert et al. ..... 343/770
5,502,453 A * 3/1996 Tsukamoto et al. ..... 343/756
5,619,216 A * 4/1997 Park ..... 343/771
5,977,924 A * 11/1999 Takei et al. ..... 343/770
6,229,484 B1 * 5/2001 Sagisaka ..... 343/700 MS
6,507,321 B2 * 1/2003 Oberschmidt et al. ..... 343/770
6,573,872 B2 * 6/2003 Oberschmidt et al. ..... 343/767

* cited by examiner

*Primary Examiner*—Shih-Chao Chen
(74) *Attorney, Agent, or Firm*—Katten Muchin Zavis Rosenman

(57) ABSTRACT

A two-element slot line array antenna comprises a substrate having a first and a second main surface, a conductor disposed on the first main surface, a slot line formed in the conductor, and a pair of slot line antenna elements formed in the conductor. The slot line has one end side electromagnetically coupled to the pair of antenna elements, and the other end side serving as a feed end. The pair of antenna elements is arranged in parallel with an electric field plane or a magnetic field plane formed by the slot line. The pair of antenna elements and the slot line are arranged in mirror symmetry with respect to a magnetic field plane or electric field plane which starts at the feed end, so that the pair of antenna elements is excited in phase.

25 Claims, 24 Drawing Sheets

TWO-ELEMENT AND MULTI-ELEMENT PLANAR ARRAY ANTENNAS

BACKGROUND OF THE INVENTION

1. Field of the Invention

The present invention relates to a slot line planar antenna, and more particularly to a two-element and a multi-element slot line antenna which are simple in configuration and have a plurality of arrayed slot line antenna elements that are excited in phase.

2. Description of the Related Arts

Planar antennas are widely used in, for example, radio communications and satellite broadcasting because of their characteristics of ease in machining, small size, light weight, and the like. Planar antennas are classified into a microstrip line type, a slot line type, and the like. Generally, the microstrip line planar antenna is often used since it has a simple feed system structure, good radiation characteristics, and the like.

However, the microstrip line planar antenna is disadvantageous in a narrow frequency band in which it can operate a relatively low antenna gain, and difficulties in suppressing orthogonal components from antenna elements and feed system. From the foregoing, the slot line planar antenna has gained the spotlight because it has wide band frequency characteristics and less radiations of orthogonal components from antenna elements themselves, as compared with the microstrip line planar antenna.

Exemplary configurations of conventional slot line planar antennas will be described with reference to FIGS. 1A, 1B, 2A, 2B, 3A, 3B, 4A, 4B and 5. In the accompanying drawings, dotted portions on plan views represent areas over which conductors are formed on a first main surface of a substrate. Solid black areas in cross-sectional views represent cross-sections of conductors.

Each of illustrated slot line planar antennas comprises a substrate 1 made of a dielectric material or the like; antenna element 3 through which electromagnetic waves are transmitted or received, and feed systems 4*a* to 4*c* for transmission and reception disposed on substrate 1. Antenna element 3 is formed by routing a so-called slot line, which is a linear or loop-shaped open line, in conductor 2 formed on one main surface of substrate 1. A resonant frequency on an electric field plane depending on the length of the slot line is defined as a frequency at which electromagnetic waves are transmitted and received through antenna element 3. Generally, the length of the slot line is set to $\lambda/2$, where $\lambda$ is the wavelength of the transmission and reception frequency.

In slot line antenna element 3, the slot line is a balanced transmission line, and an electric field plane is produced in a direction orthogonal to an electric field which is excited in the same direction alternately between the conductors on both sides of the open line, so that a complete standing wave of electromagnetic field is generated in the slot line. Generally, a cross section in the electric field direction, i.e., in the width direction of the open line is referred to as an electric field plane (E plane), and a cross section in the magnetic field direction, i.e., in the lengthwise direction of the open line is referred to as a magnetic field plane (H plane).

In the slot line planar antenna, since the slot line is formed on one main surface of substrate 1 on which conductor 2 is formed to produce the electromagnetic field plane on the same surface, less orthogonal components are produced in the electric field plane and magnetic field plane, as compared with a microstrip line planar antenna in which an electric field is excited between both main surfaces of a substrate.

In a slot line planar antenna, a microstrip line or a coplanar line, for example, is selected for a feed system when slot line antenna element 3 is linear. A slot line planar antenna illustrated in FIGS. 1A and 1B comprises linear slot line antenna element 3 and a feed system based on microstrip line 4*a*. Microstrip line 4*a*, which constitutes the feed system, is formed on the other main surface of substrate 1 such that it is in close proximity to one end of slot line antenna element 3 in the lengthwise direction, and extends in a direction orthogonal to the lengthwise direction of antenna element 3. Microstrip line 4*a* is electromagnetically coupled to slot line antenna element 3.

A slot line planar antenna illustrated in FIGS. 2A and 2B comprises a linear slot line antenna element 3 and a feed system based on coplanar line 4*b*. Coplanar line 4*b* is formed on one main surface of substrate 1 such that it extends from the center of slot line antenna element 3 in a direction orthogonal to the lengthwise direction of slot line antenna element 3.

When slot line antenna element 3 is formed in a loop shape as illustrated in FIGS. 3A and 3B, slot line 4*c*, for example, is selected for a feed system. In this event, feed slot line 4*c* is routed on one main surface of substrate 1, and is connected to one end side of a corner of the slot line which constitutes antenna element 3.

In the respective slot line planar antennas described above, electromagnetic waves, i.e., high frequency signals, are propagated from the feed system, which may be a microstrip line, a coplanar line or a slot line, to slot line antenna element 3 or from slot line antenna element 3 to the feed system upon transmission and reception.

Since these planar antennas each provide a low antenna gain with single slot line antenna element 3, a plurality of slot line antenna elements 3 are arranged to form, for example, an array antenna for improving the antenna gain. FIG. 4 illustrates an array antenna which comprises a plurality of linear slot line antenna elements 3, for example, arranged one-dimensionally on one side of microstrip line 4*a* which serves as a feed system. FIG. 5 illustrates an array antenna using loop-shaped slot line antenna elements 3 which are arranged on both sides of coplanar line 4*b*, which serves as a feed system, through short feed slot line. Pairs of slot line antenna elements 3 are arranged in the longitudinal direction of coplanar line 4*b*.

However, either of the foregoing slot line array antennas has slot line antenna elements 3 simply arranged one-dimensionally along the feed system, which is made of the microstrip line or coplanar line, formed on one main surface of substrate 1. It is difficult to two-dimensionally arrange such antenna elements to form a multi-element array antenna.

When a two-dimensional array antenna is implemented by placing two or two pairs or more of slot line antenna elements 3 not only along the longitudinal direction of a feed system but also in a direction orthogonal to which the feed system extends, the feed system will interlace on one main surface of substrate 1, causing difficulties in providing a multi-element array antenna. In this event, even if the feed system drawn about to arrange antenna elements in two-dimensional directions, the respective slot line antenna elements will be fed from a feed end with different feed lengths from one another, thereby making it difficult to excite the respective slot line antenna elements in phase, with a resulting reduction in the directivity. Of course, the reduction in the directivity can be avoided if the feed system is set such that the antenna elements are matched in phase, in which case, however, complicated designing is imposed for the feed systems. In addition, when microstrip lines alone are used for the feed system in an array antenna, orthogonal components are necessarily produced and can be difficult to suppress.

While an existing two-dimensional multi-element antenna array employs a feed system comprised of tubular metal waveguides such as radial lines or the like, the use of the tubular waveguides results in a three-dimensional structure, inevitably causing a large sized antenna array.

As described above, a planar antenna having slot line antenna elements is practically limited to a one-dimensional array antenna in actuality due to a feed system based on a microstrip line, a coplanar line or a slot line. Therefore, a demand exists for realization of a practical two-dimensional multi-element array antenna in a planar circuit configuration. In the following description, the term "slot line array antenna" is given to a planar array antenna which comprises a plurality of slot line antenna elements arranged in a planar configuration.

SUMMARY OF THE INVENTION

It is an object of the present invention to provide a two-element slot line array antenna which is simple in configuration, exhibits a good directivity, and functions as a basic unit when a plurality of slot line antenna elements are two-dimensionally arranged to form a planar array antenna.

It is another object of the present invention to provide a multi-element slot line array antenna which is simple in configuration, and exhibits a good directivity.

A slot line array antenna according to the present invention comprises, as a basic configuration, a substrate having a first and a second main surface, a conductor disposed on the first main surface, a slot line formed in the conductor, a pair of slot line antenna elements formed in the conductor, and a feed system disposed on the substrate and having a feed end for feeding the pair of antenna elements. The feed system includes the slot line. In this basic configuration, the pair of antenna elements are arranged in parallel with an electric field plane or a magnetic field plane formed by the slot line. The pair of antenna elements and slot line are arranged in mirror symmetry with respect to a magnetic field plane or electric field plane which starts at the feed end, so that the pair of antenna elements are excited in phase.

The basic configuration is a two-element slot line array antenna which has a pair of slot line antenna elements arranged in mirror symmetry, including the feed system, for excitation in phase. The two-element slot line array antenna has the same feed length from the feed end to each antenna element, and therefore exhibits a good directional characteristic.

In the present invention, the basic configurations can be combined to form a multi-element slot line array antenna which has 4, 8, 16, or a larger number of antenna elements. Specifically, a pair of primary basic units, each of which is the two-element slot line array antenna described above, are arranged along an electric field plane or a magnetic field plane orthogonal to the direction in which the slot line antenna elements are arranged. The feed ends of the feed systems in the respective primary basic units are connected to each other to form a common feed line, and a feed line is routed to intersect with the common feed line at the midpoint thereof. A resulting four-element slot line array antenna has four antenna elements likewise arranged in mirror symmetry, and corresponds to a secondary basic unit.

In this way, a pair of feed end sides in the previous order basic units is connected to each other to form a common feed line, the previous order basic units are arranged along an electric field plane or a magnetic field plane orthogonal to the direction in which the second previous order basic units are arranged in the previous order basic units, and a feed line is routed to intersect with the common feed line at the midpoint thereof. A resulting multi-element slot line array antenna has a number of slot line antenna elements twice as much as those included in the previous order basic units. Since the slot line antenna elements are arranged in mirror symmetry with respect to the electric field plane or magnetic field plane starting at the feed end likewise in such a multi-element slot line array antenna, the array antenna has the same feed length from the feed end to each slot line antenna element. Consequently, the array antenna is free from a phase difference between the respective antenna elements, and exhibits a good directional characteristic.

In the multi-element slot line array antenna according to the present invention, feed lines, which make up the feed system, are routed independently of each other, and electromagnetically coupled to each other between both main surfaces of the substrate, thereby preventing the feed lines from interlacing on the same main surface of the substrate. Thus, the present invention can create a compact multi-element array antenna using slot line antenna elements in a planar structure, rather than a three-dimensional structure, in a simple configuration.

The present invention also provides a variety of two-element slot line array antennas, each of which oscillates in phase. Also, particularly, in the present invention, a feed line in a slot line structure is provided on a first main surface of a substrate, and a feed line in a microstrip line structure is provided on a second main surface of the substrate, as a feed system, to actively utilize electromagnetic coupling between the slot line and microstrip line, a function of series in-phase branch or a series in-phase combination therebetween, and a function of parallel anti-phase branch or parallel anti-phase combination therebetween.

DETAILED DESCRIPTION OF THE INVENTION

Figure 1A:
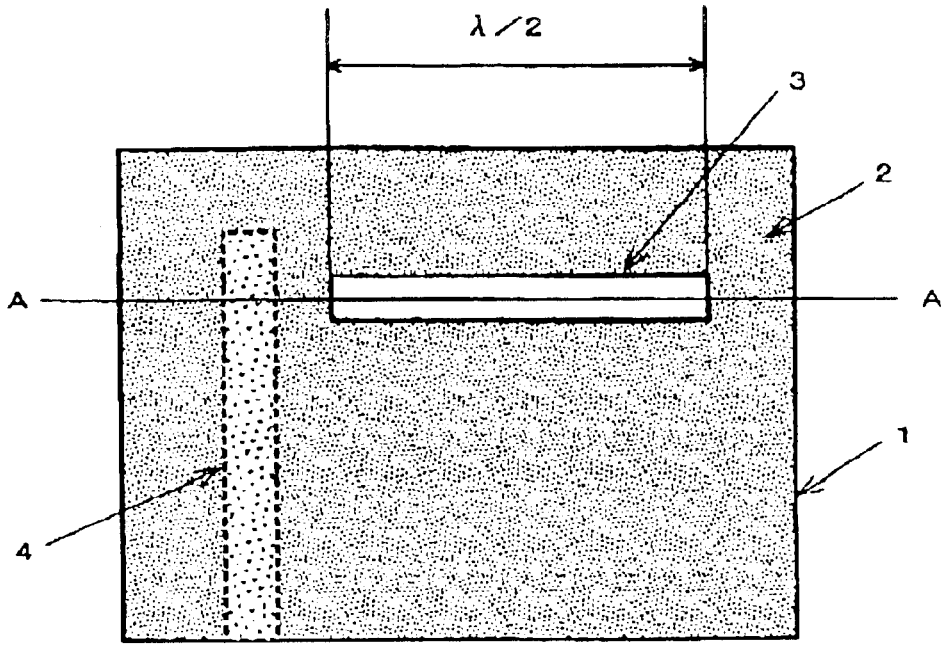
FIG. 1A (BACKGROUND ART)
FIG. 1A is a plan view illustrating an exemplary configuration of a conventional planar antenna.
Figure 1B:
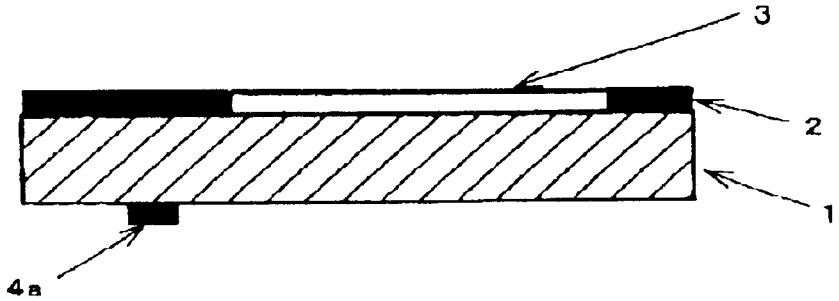
FIG. 1B (BACKGROUND ART)
FIG. 1B is a cross-sectional view taken along line A—A in FIG. 1A.
Figure 2A:
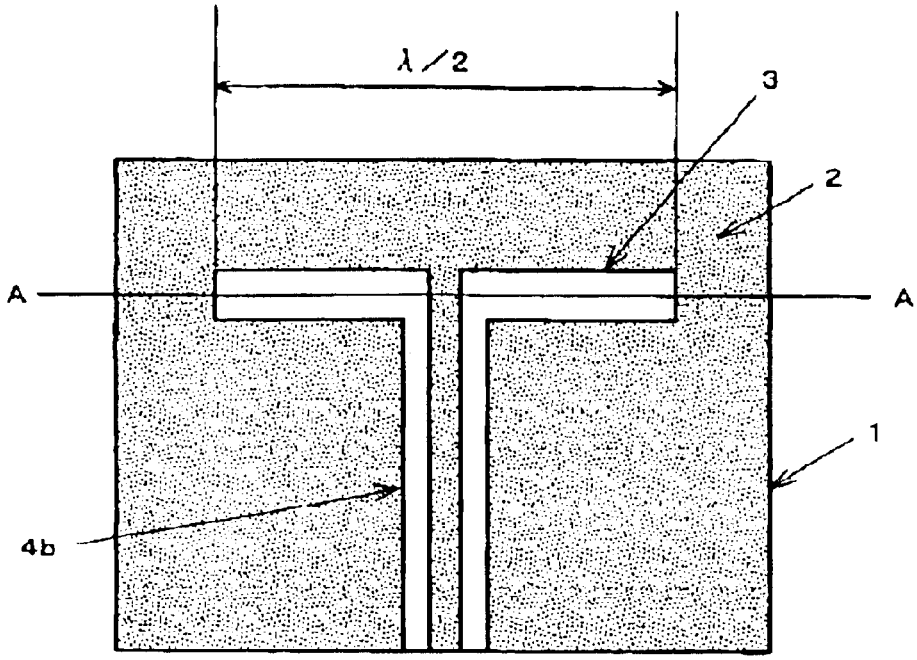
FIG. 2A (BACKGROUND ART)
FIG. 2A is a plan view illustrating another exemplary configuration of a conventional planar antenna.
Figure 2B:
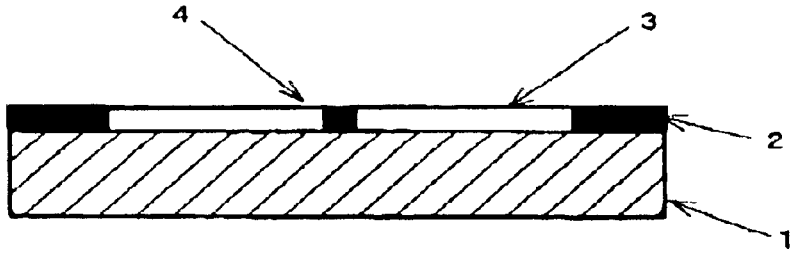
FIG. 2B (BACKGROUND ART)
FIG. 2B is a cross-sectional view taken along line A—A in FIG. 2A.
Figure 3A:
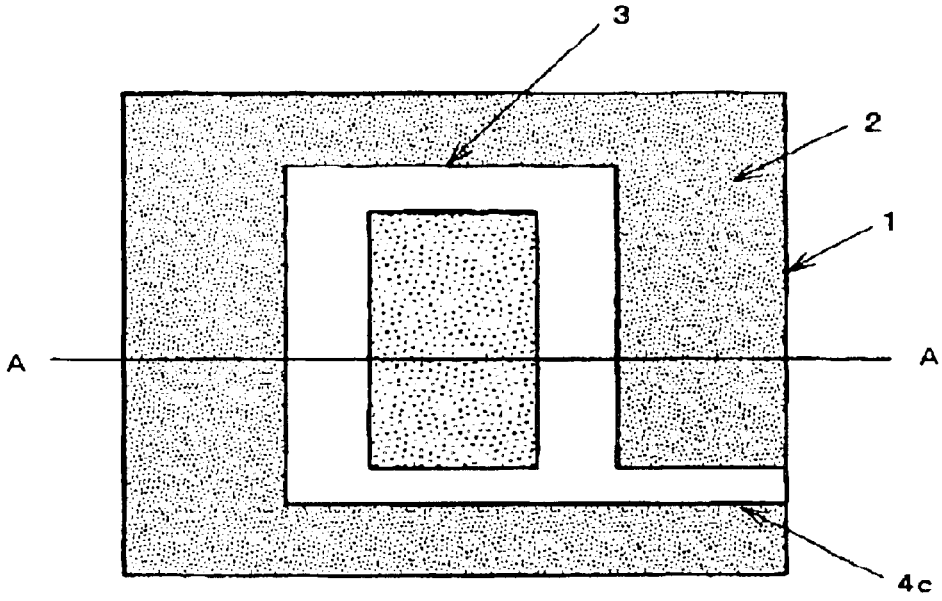
FIG. 3A (BACKGROUND ART)
FIG. 3A is a plan view illustrating a further exemplary configuration of a conventional planar antenna.
Figure 3B:
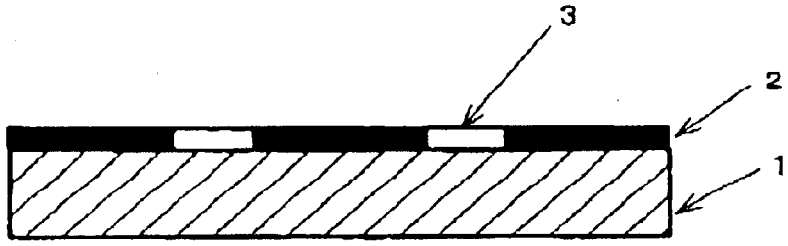
FIG. 3B (BACKGROUND ART)
FIG. 3B is a cross-sectional view taken along line A—A in FIG. 3A.
Figure 4:
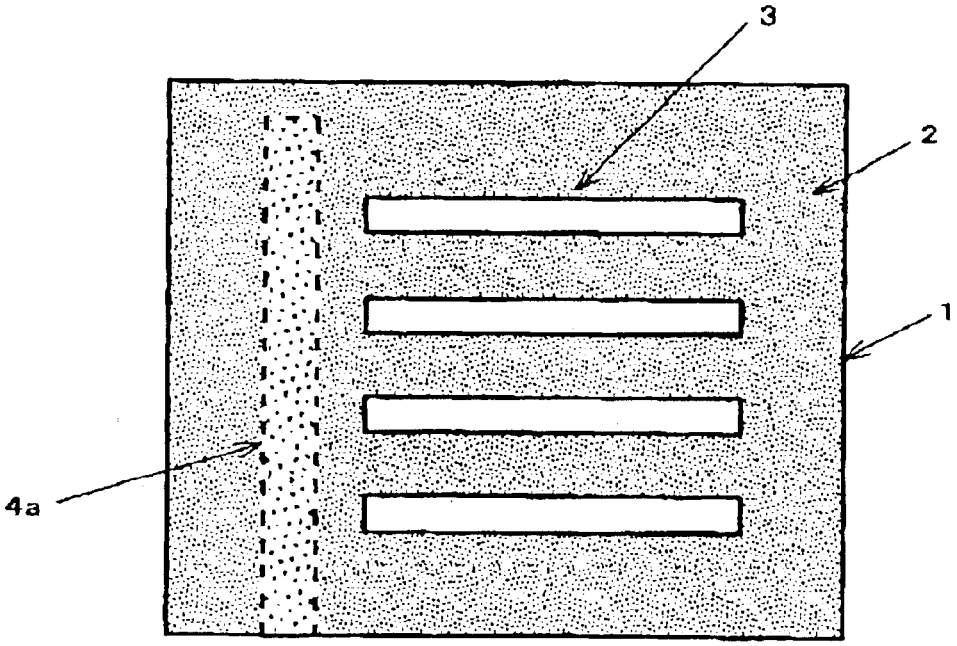
FIG. 4 (BACKGROUND ART)
FIG. 4 is a plan view illustrating an exemplary configuration of a conventional planar array antenna.
Figure 5:
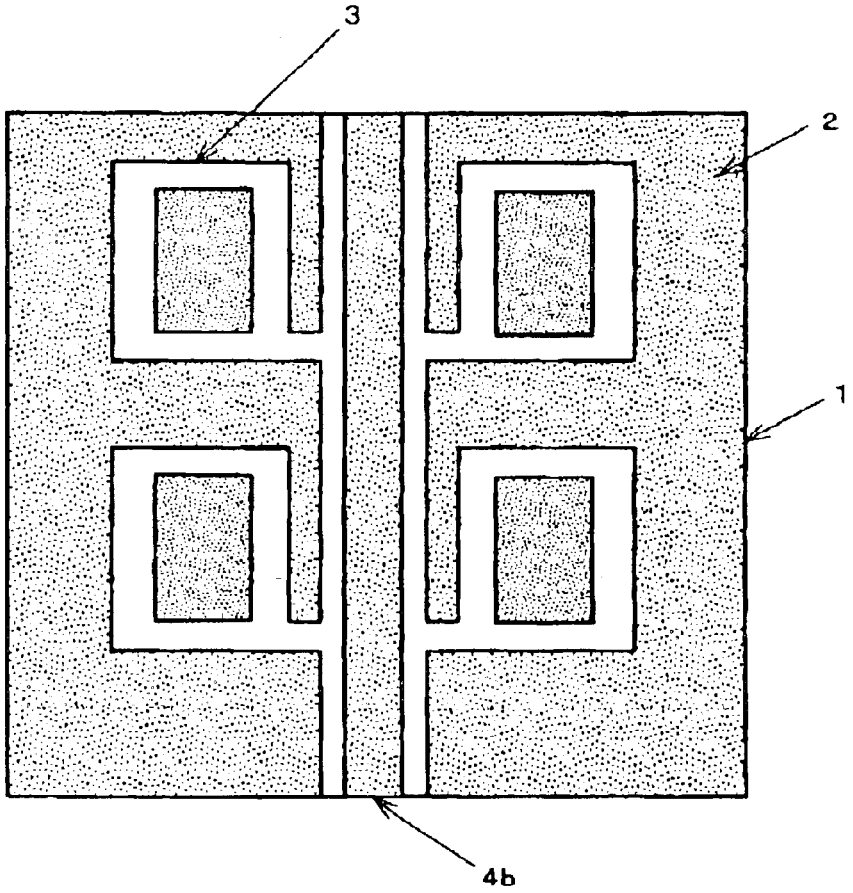
FIG. 5 (BACKGROUND ART)
FIG. 5 is a plan view illustrating another exemplary configuration of a conventional planar array antenna.
Figure 6A:
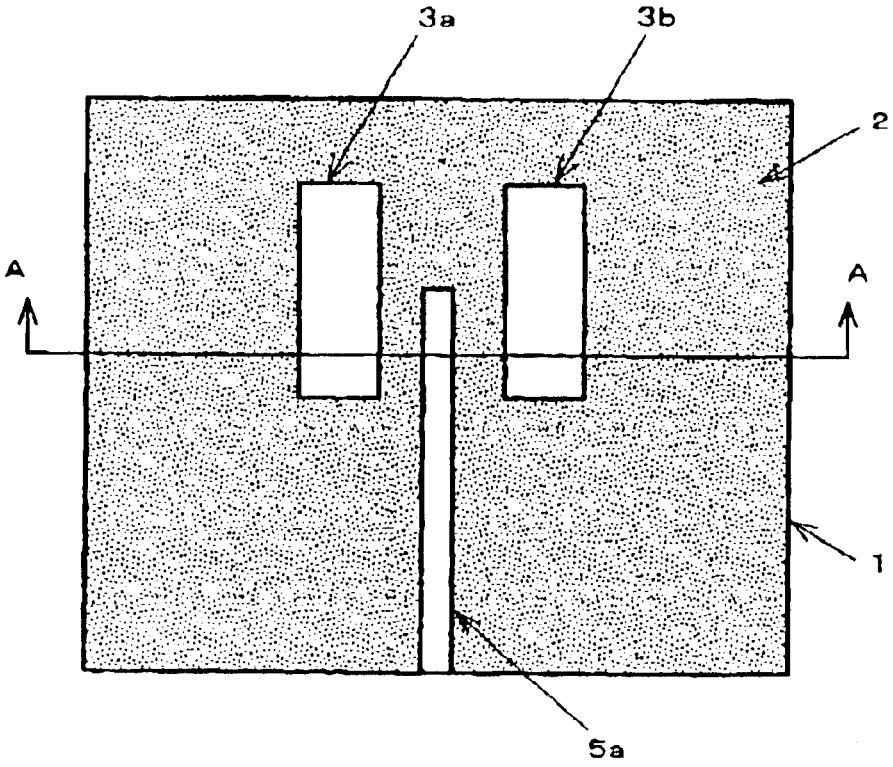
FIG. 6A is a plan view illustrating a two-element slot line array antenna according to a first embodiment of the present invention.
Figure 6B:
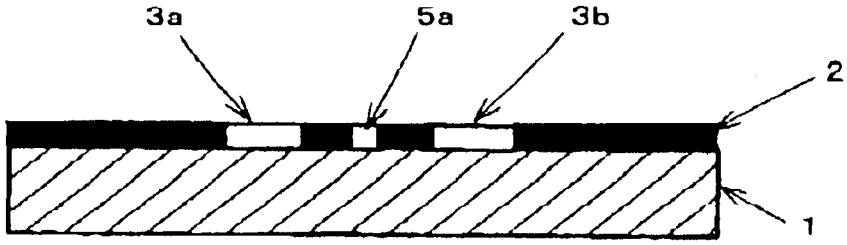
FIG. 6B is a cross-sectional view taken along a line A—A in FIG. 6A.

FIGS. 6A and 6B illustrate a two-element slot line planar array antenna according to a first embodiment of the present invention. This planar array antenna comprises substrate 1 made of a dielectric material or the like; conductor 2 formed substantially over the entirety of one main surface of substrate 1; and a pair of linear slot line antenna elements 3*a*, 3*b* formed in conductor 2. Slot line antenna elements 3*a*, 3*b* are identical in size and are disposed in parallel with each other. Conductor 2 is further formed with feed slot line 5*a* as a feed system for slot line antenna elements 3*a*, 3*b*. Slot line 5*a* is linearly routed in parallel with the direction in which antenna elements 3*a*, 3*b* extend such that it is evenly spaced from respective slot line antenna elements 3*a*, 3*b*. Slot line 5*a* has one end extending to a central region of slot line antenna elements 3*a*, 3*b* in the longitudinal direction. The other end of slot line 5*a* extends toward one side of substrate 1 and serves as a feed end.

In the foregoing configuration, the pair of slot line antenna elements 3*a*, 3*b* are arranged on both sides of feed slot line 5*a* about one end side thereof, i.e., in parallel with and in close proximity to each other along an electric field plane of slot line 5*a* to such an extent that they are electromagnetically coupled to slot line 5*a*. Then, slot line 5*a* overlaps each of slot line antenna elements 3*a*, 3*b* from one end to a central region thereof in the lengthwise direction. In addition, the pair of antenna elements 3*a*, 3*b* electromagnetically coupled to the feed system are arranged in mirror symmetry with respect to a magnetic field plane starting at the feed end, including the feed system.

In the planar array antenna as described above, assuming an operation during transmission given as an example, a high frequency signal from the feed end of feed slot line 5*a* is electromagnetically coupled simultaneously with the pair of slot line antenna elements 3*a*, 3*b* in phase, because slot line 5*a* is a balanced transmission line and produces an electric field alternately in the same direction, so that antenna elements 3*a*, 3*b* can be fed, i.e., excited. Since antenna elements 3*a*, 3*b* are arranged in mirror symmetry with respect to the magnetic field plane starting at the feed end, the resulting planar array antenna has the same feed length from the feed end to slot line antenna elements 3*a*, 3*b*, and therefore the pair of slot line antenna elements 3*a*, 3*b* can be excited in phase without phase shift to each other. Therefore, the planar array antenna exhibits a good directivity. Here, since the pair of slot line antenna elements 3*a*, 3*b* are in close proximity to each other, they may be effectively regarded as a single antenna element. While the operation during transmission has been herein described, the operation during reception is similar to the foregoing.

With a slot line planar antenna, electromagnetic waves are radiated from both main surfaces of substrate 1. For radiating an electromagnetic wave only from one of the main surfaces of the substrate, a shielding metal package or the like may be provided on the main surface opposing to that from which the electromagnetic wave is irradiated. The same is applied to the following embodiments.

Figure 7:
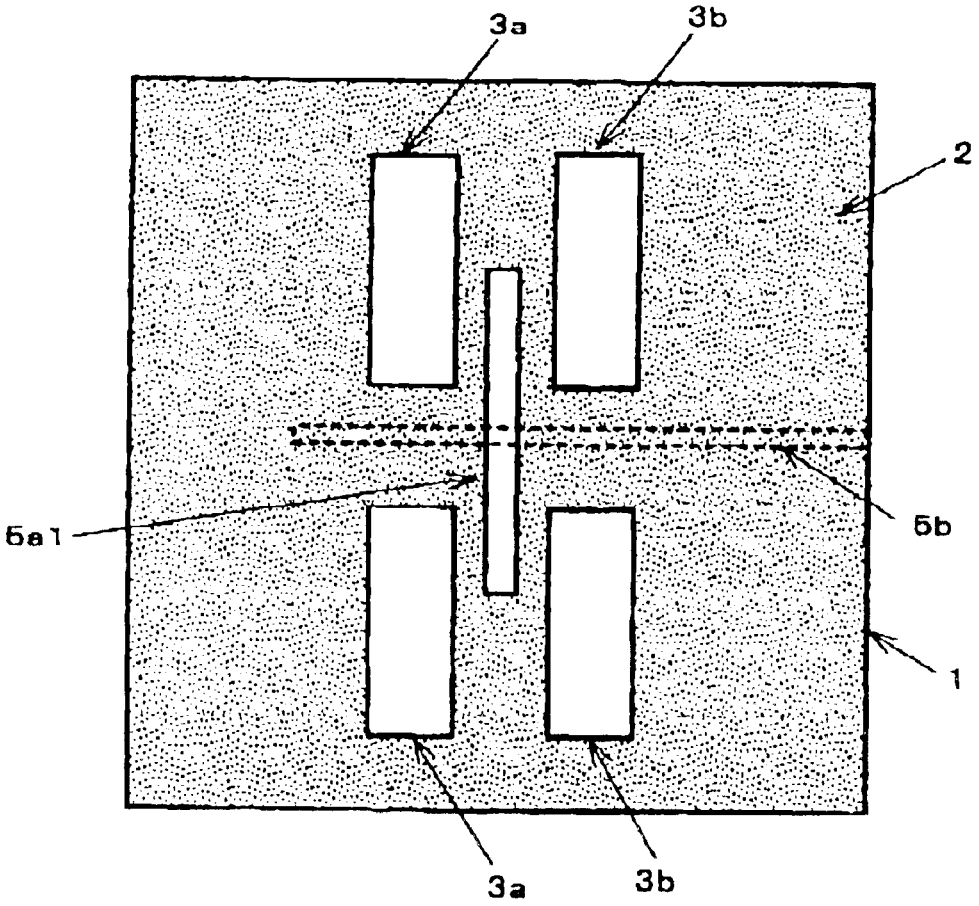
FIG. 7 is a plan view illustrating a four-element slot line array antenna based on the first embodiment.

While FIGS. 6A and 6B illustrate a two-element planar array antenna, FIG. 7 illustrates a four-element slot line planar array antenna which is extended from the two-element planar array antenna. The four-element slot line array antenna illustrated in FIG. 7 comprises a pair of primary basic units, each of which is the two-element slot line array antenna illustrated in FIGS. 6A and 6B, arranged in mirror symmetry.

Here, common feed slot line 5a1 is formed for the respective basic units such that the feed slot lines of the respective basic units are connected to each other at their respective feed end sides. Specifically, a pair of basic units is arranged in parallel with each other on one main surface of substrate 1 along a magnetic field plane orthogonal to an electric field plane on which a pair of slot line antenna elements 3a, 3b is arranged in each basic unit. Then, substrate 1 is formed with feed microstrip line 5b on the other main surface of substrate 1 which extends in a direction orthogonal to the direction in which common feed slot line 5a1 extends and traverses common feed slot line 5a1 at the midpoint thereof. One leading end of microstrip line 5b extends by λ/4 from the midpoint of slot line 5a1, and is electrically short-circuited, where λ is a wavelength corresponding to an operating frequency of the antenna. The other end of microstrip line 5b extends toward one side of substrate 1 and serves as a feed end. Conductor 2 on one main surface of substrate 1 also functions as a ground plane for microstrip line 5.

In the manner described above, the resulting four-element slot line array antenna is arranged in mirror symmetry with respect to the electric field plane starting at the feed end of feed microstrip line 5b.

In the configuration as described above, a high frequency signal from microstrip line 5b is branched at the midpoint of common feed slot line 5a1 into two high frequency components in phase having the same amplitude, each of which excites an associated pair of slot line antenna elements 3a, 3b in phase on both end sides of common feed slot line 5a1. Even in this event, the slot line array antenna is arranged in mirror symmetry with respect to the electric field plane starting at the feed end of microstrip line 5b, resulting in the same feed length from the feed end to each slot line antenna element 3a, 3b. Thus, the resulting planar array antenna exhibits a good directivity.

In the above configuration, feed microstrip line 5b having one end which traverses common feed slot line 5a1 at the midpoint thereof and is electrically short-circuited, and the other end which serves as a feed end is formed on the other main surface of substrate. Alternatively, one end of microstrip line 5b may be electrically short-circuited by connecting the one end to one main surface of substrate 1 on the left side of slot line 5a1 through a via-hole.

Figure 8:
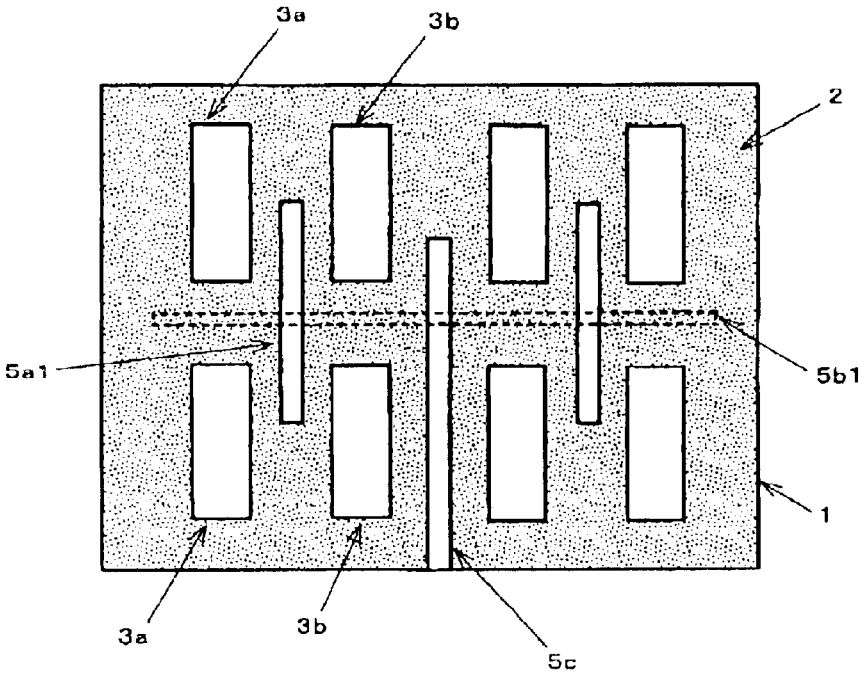
FIG. 8 is a plan view illustrating an eight-element slot line array antenna based on the first embodiment.

Further, two sets of the four-element slot line planar array antennas can be assembled to form an eight-element slot line array antenna as illustrated in FIG. 8.

The eight-element slot line array antenna illustrated in FIG. 8 comprises a pair of secondary basic units, each of which is the four-element slot line array antenna illustrated in FIG. 7, arranged in mirror symmetry.

Common feed microstrip line 5b1 is formed for the respective secondary basic units such that feed microstrip lines 5b in the respective secondary basic units (i.e., four-element slot line array antennas) are connected to each other at their respective feed end sides. Specifically, a pair of secondary basic units is arranged in parallel with each other on one main surface of substrate 1 along an electric field plane orthogonal to a magnetic field plane on which a pair of primary basic units is arranged in each secondary basic unit. Then, second feed slot line 5c is formed on the one main surface of substrate 1 which extends in a direction orthogonal to the direction in which common feed microstrip line 5b1 extends, and traverses the midpoint of common feed microstrip line 5b1. One end of slot line 5c extends by λ/4 from the midpoint of microstrip line 5b1, and is electrically opened, where λ is a wavelength corresponding to an operating frequency of the antenna. The other end of slot line 5c extends toward one side of substrate 1 and serves as a feed end.

The resulting eight-element slot line array antenna has eight antenna elements arranged in mirror symmetry with respect to a magnetic field plane starting at the feed end of second feed slot line 5c.

In the configuration as described above, a high frequency signal from feed slot line 5c is branched from the midpoint of common microstrip line 5b1 into two high frequency components in opposite phase having the same amplitude which reach both ends of common feed microstrip line 5b1. The high frequency component at each end of microstrip line 5b1 is again branched from the midpoint of intersecting slot line 5a1 into two high frequency components in phase having the same amplitude. As a result, a total of eight slot line antenna elements of the secondary basic units (i.e., four-element slot line array antennas) are excited in phase.

Figure 9:
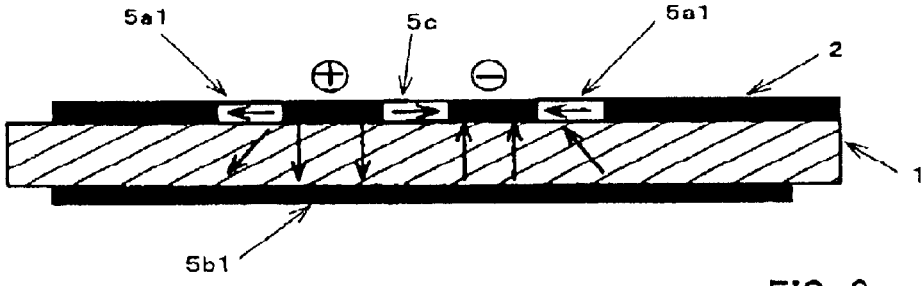
FIG. 9 is a cross-sectional view illustrating the operation of the antenna illustrated in FIG. 6.

FIG. 9 is a cross-sectional view illustrating an electric field distribution in the eight-element slot line array antenna illustrated in FIG. 8. Assuming that an electric field is produced from left to right, for example, between conductors on both sides of slot line 5c at a position at which slot line 5c crosses common feed microstrip line 5b1 when a high frequency signal is applied from the feed end of feed slot line 5c, a downward electric field is produced from a conductor on the left side of slot line 5c, and an upward electric field is produced from a conductor on the right side of slot line 5c, with respect to common feed microstrip line 5b1 routed on the other main surface of substrate 1. Therefore, the high frequency signal is branched into to two high frequency components in opposite phase from the intersection of slot line 5c with common feed microstrip line 5b1, so that high frequency components propagate toward both ends of microstrip lines 5b1 in opposite directions from each other, with electric fields opposing each other between both main surfaces of substrate 1

Then, the downward electric field in a left-hand region and the upward electric field in a right-hand region in FIG. 9 each produce a leftward electric field in slot line 5a1 at intersections of microstrip line 5b with both common feed slot lines 5a1. Therefore, the high frequency signals are propagated from common feed microstrip line 5b1 to common feed slot lines 5a1 in phase. Consequently, four slot line antenna elements 3 are excited in phase in the respective secondary basic units disposed on both sides of slot lines 5a1. The in-phase excitations in such antenna elements are caused by the mirror symmetry, with respect to feed slot line 5c, in the connections of common feed microstrip line 5b1 with a pair of common fed slot lines 5a1 through electromagnetic coupling.

Likewise, since the eight-element slot line array antenna is arranged in mirror symmetry with respect to the electric field plane starting at the feed end of feed slot line 5c, the eight-element slot line array antenna exhibits a good directivity because of the same feed length from the feed end to respective slot line antenna elements 3a.

Figure 10:
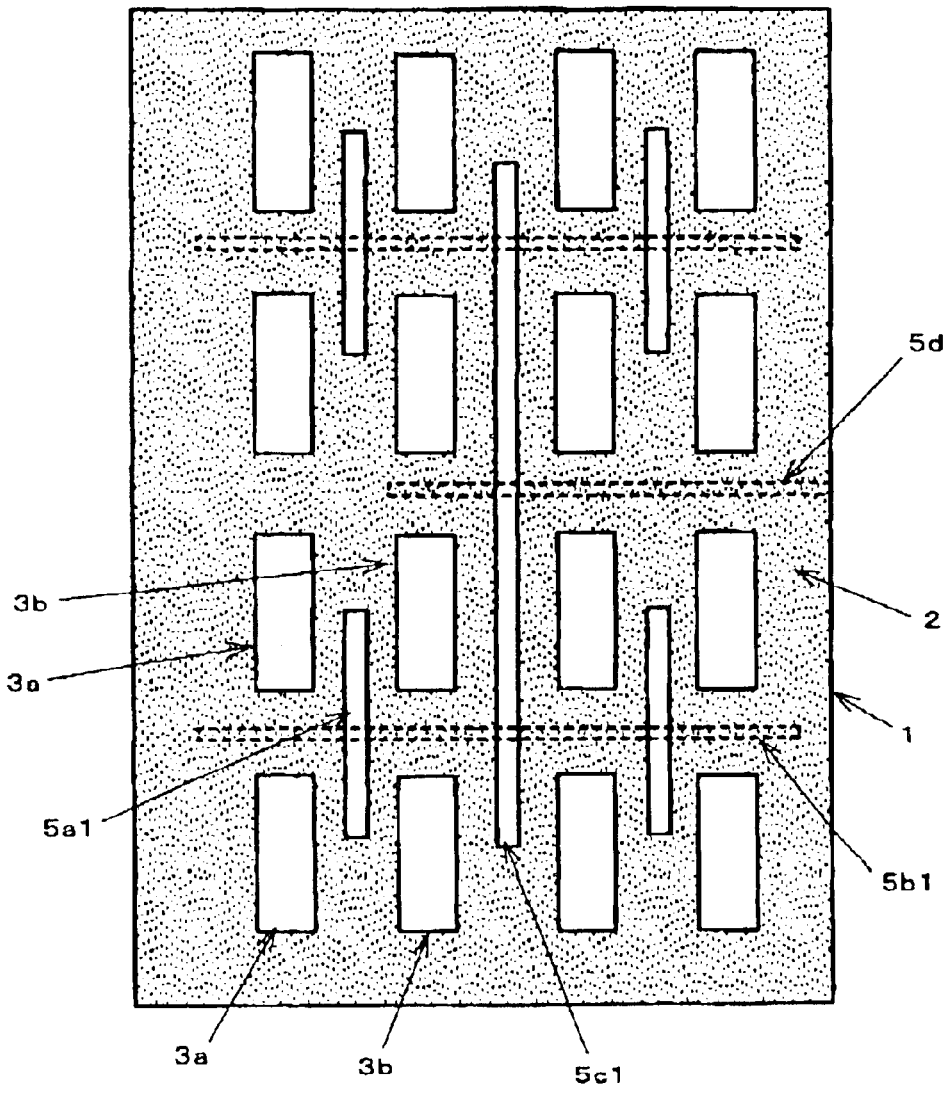
FIG. 10 is a plan view illustrating a 16-element slot line array antenna based on the first embodiment.

A pair of the eight-element slot line array antennas can be combined to form a 16-element slot line array antenna as illustrated in FIG. 10. The 16-element slot line array antenna illustrated in FIG. 10 comprises a pair of third-order basic units, each of which is the eight-element slot line array antenna illustrated in FIG. 8, arranged in mirror symmetry. Specifically, common feed slot line 5c1 is formed for the respective third-order basic units such that slot lines 5c of the respective third-order basic units (i.e., eight-element slot line antennas) are connected to each other at their respective feed end sides. More specifically, a pair of third-order basic units is disposed on one main surface of substrate 1 in parallel with each other along a magnetic field plane orthogonal to an electric field plane on which a pair of secondary basic units is arranged in each third-order basic unit. Second microstrip line 5*d* is formed on the other main surface of substrate 1, which extends in a direction orthogonal to the direction in which common feed slot line 5*c*1 extends and traverses the midpoint of common feed slot line 5*c*1. One end of microstrip line 5*d* is an electrically short-circuited end, while the other end of microstrip line 5*d* extends toward one side of substrate 1 and serves as a feed end.

The resulting 16-element slot line array antenna is arranged in mirror symmetry with respect to an electric field plane starting at the feed end of feed microstrip line 5*d*.

In the configuration as described above, a high frequency signal from feed microstrip line 5*d* is branched from the midpoint of common feed slot line 5*c*1 into two high frequency components in phase having the same amplitude which reach both ends of slot line 5*c*1. On both end sides of slot line 5*c*1, each high frequency component is branched in opposite phase into two high frequency components from the midpoint of common feed microstrip line 5*b*1 which traverses slot line 5*c*1. Consequently, a total of 16 slot line antenna elements in the third-order basic units (i.e., eight-element slot line array antennas) are excited in phase in a manner similar to the slot line antenna illustrated in FIG. 8. Again, the planar array antenna is arranged in mirror symmetry with respect to the magnetic field plane starting at the feed end of microstrip line 5*d*, the planar array antenna exhibits a good directivity because of the same feed length from the feed end to each of 16 slot line antenna elements 3.

As described above, the planar array antenna according to the first embodiment comprises feed slot line 5*a*, which is electromagnetically coupled to antenna elements 3*a*, 3*b*, in the midway between a pair of antenna elements 3*a*, 3*b* arranged along an electric field plane in the slot line antenna elements to create a two-element array antenna so that the two-element array antenna is arranged in mirror symmetry with respect to the magnetic field plane starting at the feed end. This two-element slot line array antenna is defined to be the primary basic unit. A pair of the primary basic units are arranged in parallel along the magnetic field plane such that the feed end sides in both primary basic units are connected to each other to form common feed slot line 5*a*1, and feed microstrip line 5*b* is routed to traverse slot line 5*a*1 at the midpoint thereof. Then, a four-element slot line array antenna (secondary basic unit) is formed in such a manner that the four-element slot line array antenna is arranged in mirror symmetry with respect to an electric field plane which starts at a feed end provided by the other end of microstrip line 5*b*.

Subsequently, in a similar manner, a pair of the previous order basic units is arranged in parallel along an electric field plane or a magnetic field plane opposite to the direction in which the previous order basic units are arranged, such that feed end sides of the previous order basic units are connected to each other to form a common feed line, and a further feed line is routed to be electromagnetically coupled to the common feed line at the midpoint thereof. The further feed line comprises a slot line when the common feed line is a microstrip line, and the further feed line comprises a microstrip line when said common feed line is a slot line. Thus, a resulting multi-element slot line array antenna comprises a number of slot line antenna elements twice as much as those in the previous order slot line array antenna, and is arranged in mirror symmetry with respect to the electric field plane or magnetic field plane which starts at a global feed end. The slot line antenna elements are excited in phase in the resulting multi-element slot line array antenna.

Therefore, in the first embodiment, multi-element slot line array antennas having 32, 64, and a larger number of slot line antenna elements can be provided in addition to the aforementioned two-element, four-element, eight-element and 16-element array antennas. Since these array antennas each have the mirror symmetry configuration with respect to an electric field plane or a magnetic field plane starting at the feed end, the feed length is identical from the feed end to any of the slot line antenna elements, thereby allowing for excitation in phase without phase shift to maintain a good directivity.

Further, two sets of primary basic units, each comprised of the two-element slot line array antenna, can be arranged in mirror symmetry to form the secondary basic unit, and likewise, the next higher-order basic units can be arranged in mirror symmetry to form a multi-element slot line array antenna. Thus, according to the first embodiment, it is possible to readily create a slot line array antenna which is simple in configuration.

The alternations of a conversion from a microstrip line to a slot line and a conversion from a slot line to a microstrip line are repetitions of series branch and parallel branch. Therefore, no impedance matching circuit is essentially required between these transmission lines in these repetitions of conversions. The elimination of impedance matching circuit is likewise applied to the following embodiments.

Next, description will be made on a slot line array antenna according to a second embodiment of the present invention. A two-element slot line array antenna illustrated in FIGS. 11A and 11B, according to the second embodiment, is similar to the antenna according to the first embodiment in that a pair of slot line antenna elements 3*a*, 3*b* is arranged along an electric field plane on one main surface of substrate 1, but is basically different from the first embodiment in the configuration of a feed system for each antenna element 3*a*, 3*b*.

Specifically, conductor 2 is formed substantially over the entirety of one main surface of substrate 1 made of a dielectric material or the like, and a pair of linear slot line antenna elements 3*a*, 3*b* is disposed in conductor 2. Slot line antenna elements 3*a*, 3*b* are identical in size, and are disposed in parallel with each other. As a feed system for slot line antenna elements 3*a*, 3*b*, feed microstrip line 6*a* is routed on the other main surface of substrate 1, and a feed slot line 6*b* is formed in the one main surface of substrate 1.

A pair of slot line antenna elements 3*a*, 3*b* are arranged in parallel on both sides of slot line 6*b*, i.e., along an electric field plane produced by slot line 6*b*. Slot line 6*b* is evenly spaced from respective slot line antenna elements 3*a*, 3*b*, but is away from the pair of slot line antenna elements 3*a*, 3*b* so that slot line 6*b* is not electromagnetically coupled to slot line antenna elements 3*a*, 3*b*, unlike the first embodiment.

Feed microstrip line 6*a* traverses between midpoints of the pair of slot line antenna elements 3*a*, 3*b*, and intersects with slot line antenna elements 3*a*, 3*b*. Microstrip line 6*a* is electromagnetically coupled to the pair of slot line antenna elements 3*a*, 3*b* at both end portions, respectively. Slot line 6*b* has an electrically open end on one end side, and intersects with microstrip line 6*a* at the midpoint thereof on the one end side for electromagnetic coupling therewith. The other end of slot line 6*b* extends toward one side of substrate 1 and serves as a feed end. Slot line antenna elements 3*a*, 3*b* are arranged in mirror symmetry with respect to a magnetic field plane which starts at the feed end of feed slot line 6*b*.

In the configuration as described above, a high frequency signal from the feed end of feed slot line 6*b* is branched from the midpoint of microstrip line 6*a* into two high frequency components in opposite phase which propagate to both ends of microstrip line 6*a*, as previously described in connection with FIGS. 8 and 9, and are fed to the pair of slot line antenna elements 3*a*, 3*b* in phase. Again, since the slot line array antenna is arranged in mirror symmetry with respect to the magnetic field plane which starts at the feed end of feed slot line 6*b*, the slot line array antenna has the same feed length from the feed end to any of the pair of slot line antenna elements 3*a*, 3*b*, and therefore exhibits a good directivity.

Figure 11A:
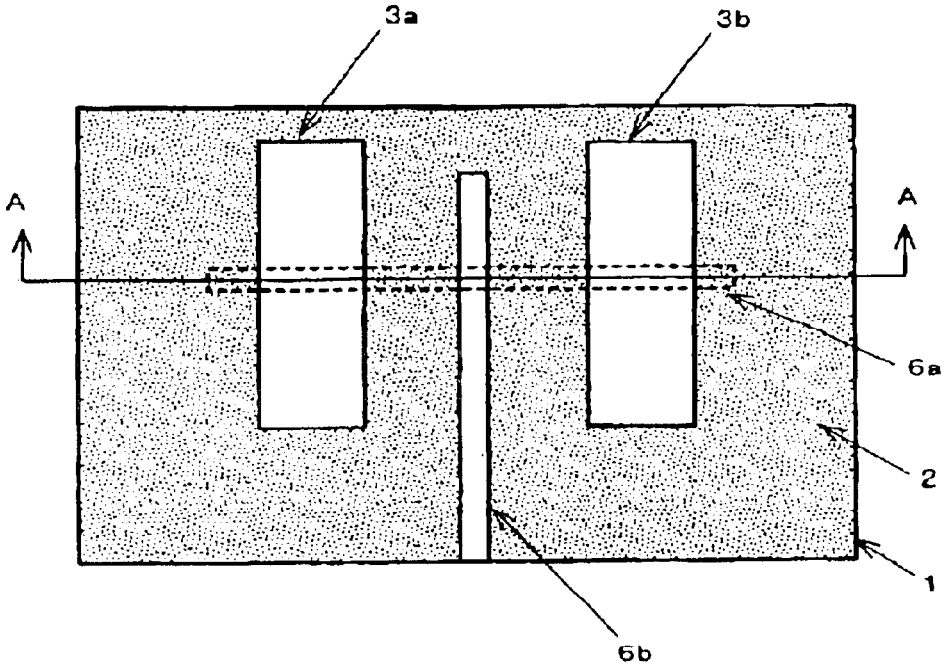
FIG. 11A is a plan view illustrating a two-element slot line array antenna according to a second embodiment of the present invention.
Figure 11B:
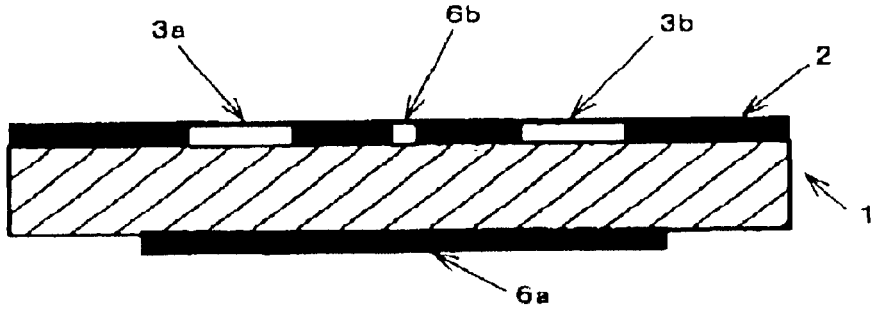
FIG. 11B is a cross-sectional view taken along a line A—A in FIG. 11A.

Like the planar array antenna according to the first embodiment, a four-element slot line array antenna can be created in the second embodiment by disposing a pair of primary basic units, each of which is the two-element slot line array antenna illustrated in FIGS. 11A and 11B, in mirror symmetry. Also, an eight-element slot line array antenna can be created by disposing a pair of secondary basic units, each of which is the four-element slot line array antenna, in mirror symmetry.

Figure 12:
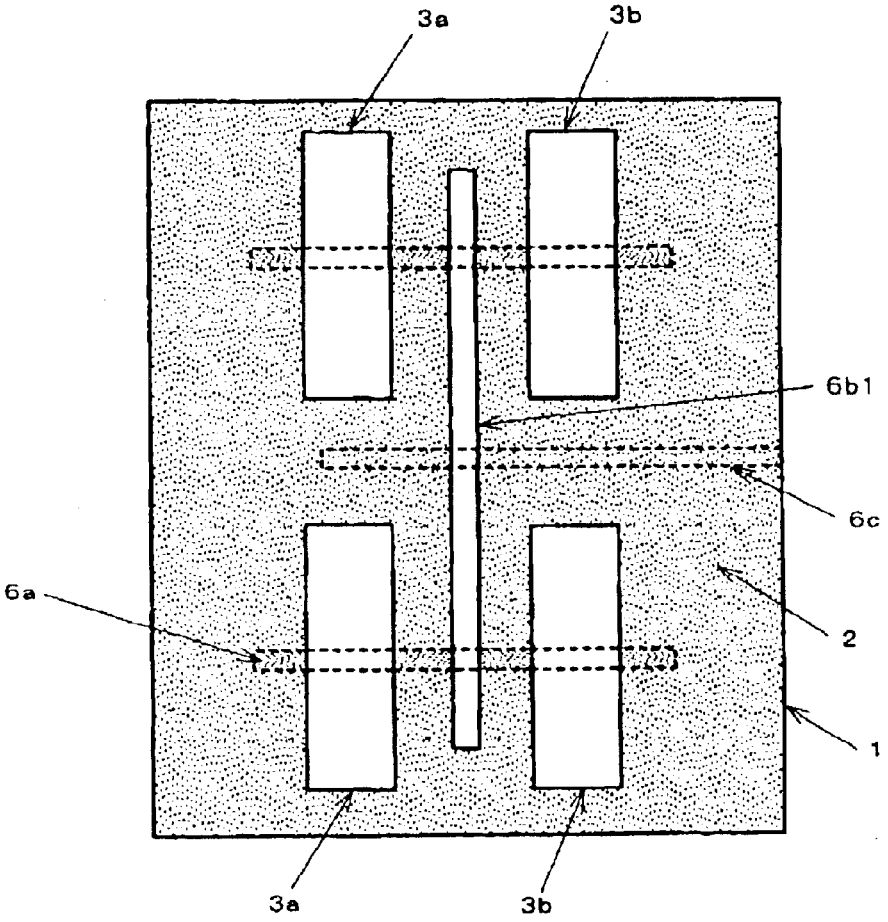
FIG. 12 is a plan view illustrating a four-element slot line array antenna based on the second embodiment.

FIG. 12 illustrates a four-element slot line array antenna which comprises a pair of primary basic units, each of which is the two-element slot line array antenna illustrated in FIGS. 11A and 11B, arranged along a magnetic field plane. Common feed slot line 6*b*1 is formed such that the feed slot lines of the respective basic units are connected to each other at their respective feed end sides. Then, feed microstrip line 6*c* is provided on the other main surface of substrate 1 such that one end thereof extends beyond the midpoint of common fed slot line 6*b*1 at which feed microstrip line 6*c* intersects with common fed slot line 6*b*1. The other end of microstrip line 6*c* extends toward one side of substrate 1 and serves as a feed end.

In the configuration as described above, a high frequency signal from feed microstrip line 6*c* is branched from the midpoint of common feed slot line 6*b*1 into two high frequency components in phase which propagate common feed slot line 6*b*1. Then, each high frequency component is branched from the intersection of slot line 6*b*1 with microstrip line 6*a*, near each end of common feed slot line 6*b*1, into two high frequency components in opposite phase. As a result, a total of four antenna elements 3*a*, 3*b* are excited in phase.

Figure 13:
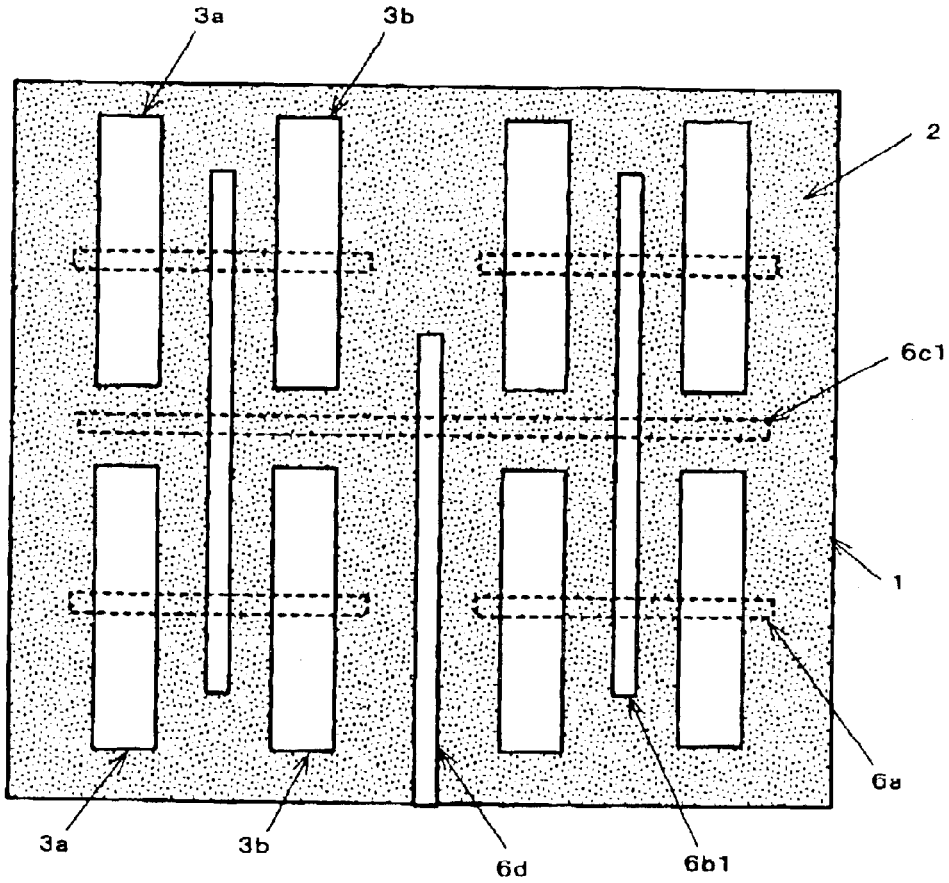
FIG. 13 is a plan view illustrating an eight-element slot line array antenna based on the second embodiment.

FIG. 13 illustrates an eight-element slot line array antenna which comprises a pair of secondary basic units, each of which is the four-element slot line array antenna illustrated in FIG. 12, arranged in parallel in an electric field plane direction. Second common feed microstrip line 6*c*1 is routed such that feed microstrip lines 6*c* of respective secondary basic units are connected to each other at their respective feed end sides. Feed slot line 6*d* is also provided on one main surface of substrate 1 such that one end thereof extends beyond the midpoint of second common feed microstrip line 6*c*1 at which feed slot line 6*d* intersects with second common feed microstrip line 6*c*1. The other end of feed slot line 6*d* extends toward one side of substrate 1 and serves as a feed end.

In the configuration as described above, a high frequency signal from feed slot line 6*d* is branched from the midpoint of second common feed microstrip line 6*c*1 into two high frequency components in opposite phase which propagate second common feed microstrip line 6*c*1 toward both ends. Each high frequency component is again branched from the intersection with common feed slot line 6*b*1, near each end of microstrip line 6*c*1, into two high frequency components in phase which propagate second common feed slot line 6*b*1 toward both ends. Further, at each end of slot line 6*b*1, the high frequency component propagates each antenna element 3*a*, 3*b* from the midpoint of strip line 6*a*. As a result, a total of eight antenna elements are excited in phase.

Likewise, in the array antenna according to the second embodiment, a pair of the previous order basic units is arranged in parallel along an electric field plane or a magnetic field plane opposite to the direction in which the previous order basic units are arranged, a common feed line is routed such that the previous order basic units are connected to each other at their respective feed end sides, and a further feed line is routed to be electromagnetically coupled to the common feed line at the midpoint thereof, in a manner similar to the array antenna according to the first embodiment. Thus, a resulting multi-element slot line array antenna comprises a number of slot line antenna elements twice as much as those in the previous order slot line array antenna. Then, a plurality of antenna elements arranged therein can be excited in phase by combining a conversion from a microstrip line to a slot line for branching a high frequency signal into two high frequency components in phase having the same amplitude with a conversion from a slot line to a microstrip line for branching a high frequency signal into two high frequency components in opposite phase having the same amplitude. Further, by arranging the array antenna in mirror symmetry with respect to an electric field plane or a magnetic field plane which starts at the feed end, the array antenna has the same feed length from the feed end to any of the antenna elements and therefore exhibits a good directional characteristic in simple configuration.

Next, description will be made on a slot line array antenna according to a third embodiment of the present invention. A two-element slot line array antenna illustrated in FIGS. 14A and 14B, according to the third embodiment, is similar to the array antenna according to the second embodiment in that it uses substrate 1 made of a dielectric material and formed with conductor 2 on one main surface thereof, a pair of slot line antenna elements 3*a*, 3*b* is arranged on one main surface of substrate 1 along an electric field plane, and they are electromagnetically coupled to each other at their respective midpoints through a microstrip line routed on the other main surface of substrate 1. However, the array antenna illustrated in FIGS. 14A and 14B differs from the array antenna according to the second embodiment in that feed region 7 is formed in a central portion of each of linear slot line antenna element 3*a*, 3*b*, and this feed region is used as part of a feed system.

A pair of antenna elements 3*a*, 3*b* are formed in their respective central portions with feed regions 7 which are comprised of coplanar lines, and protrude toward the inside so that they oppose each other. Feed microstrip line 8*a* routed on the other main surface of substrate 1 is electromagnetically coupled to feed regions 7 of antenna elements 3*a*, 3*b* at both end portions, respectively. As is the case in the second embodiment, feed slot line 8*b* is formed on the one main surface of substrate 1 such that one end thereof extends beyond the midpoint of microstrip line 8*a* at which feed slot line 8*b* intersects with microstrip line 8*a*. Feed slot line 8*b* extends in a direction in which slot line antenna elements 3 extend. The other end of slot line 8*b* extends toward one side of substrate 1, and serves as a feed end.

In the configuration as described above, a high frequency signal from slot line 8*b* is branched from the midpoint of microstrip line 8*a* into two high frequency components in opposite phase having the same amplitude which propagate toward both ends of microstrip line 8*a*. Since microstrip line 8*a* is electromagnetically coupled to feed regions 7 at both ends, respectively, the high frequency components are propagated to antenna elements 3*a*, 3*b*, respectively. Since feed regions 7 are formed as coplanar lines, the pair of antenna elements 3*a*, 3*b* are excited in phase. Again, since the array antenna is arranged in mirror symmetry with respect to a magnetic field plane which starts at the feed end of feed slot line 8*b*, the array antenna has the same feed length from the feed end to any of slot line antenna elements 3*a*, 3*b*, and therefore exhibits a good directivity.

Figure 14A:
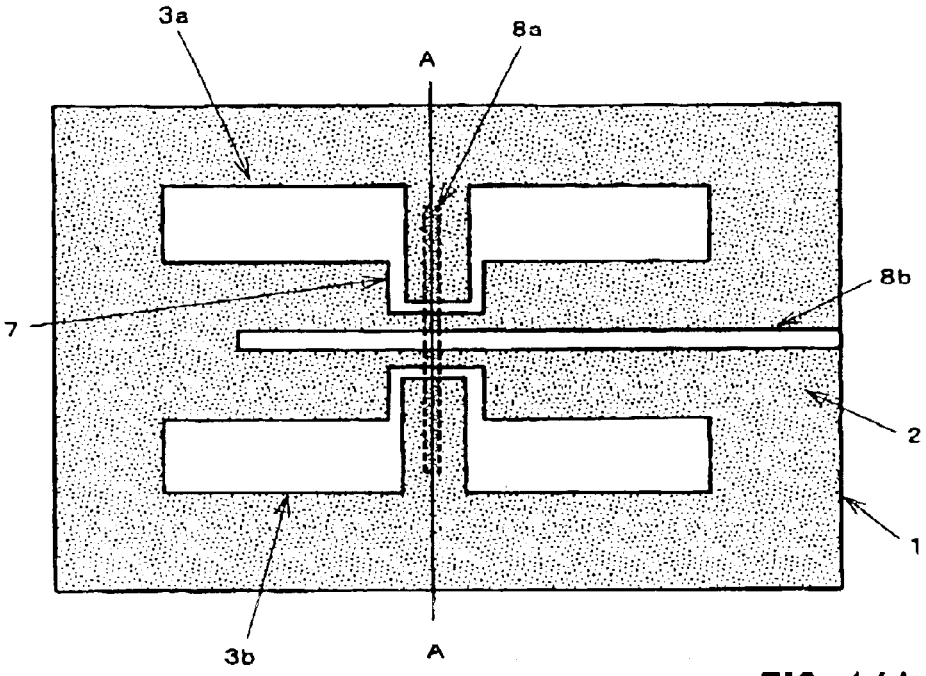
FIG. 14A is a plan view illustrating a two-element slot line array antenna according to a third embodiment of the present invention.
Figure 14B:
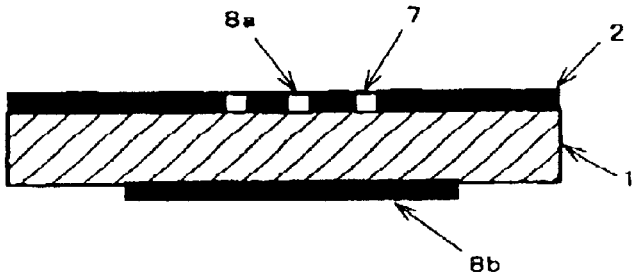
FIG. 14B is a cross-sectional view taken along a line A—A in FIG. 14A.
Figure 15:
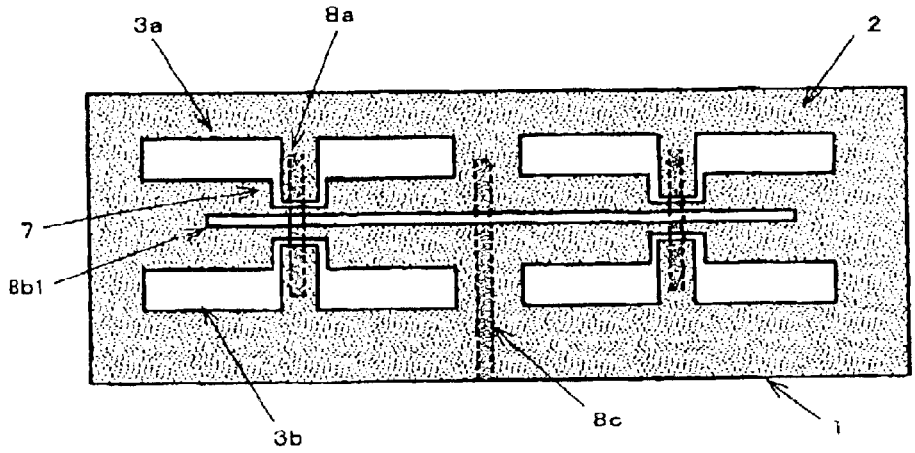
FIG. 15 is a plan view illustrating a four-element slot line array antenna based on the third embodiment.

Like the planar array antennas according to the first and second embodiments, in the third embodiment, array antennas having four, eight, 16, and a larger number of antenna elements can also be provided based on a primary basic unit which is the two-element slot line array antenna illustrated in FIGS. 14A and 14B FIG. 15 illustrates a four-element slot line array antenna which comprises a pair of the primary basic units, each of which is the two-element slot line array antenna illustrated in FIGS. 14A and 14B, arranged along a magnetic field plane. Here, the feed slot lines in the respective primary basic units are connected to each other at their respective feed end sides to constitute common feed slot line 8*b*1. Then, feed microstrip line 8*c* is routed on the other main surface of substrate 1 such that one end thereof extends beyond the midpoint of common feed slot line 8*b*1 at which feed microstrip line 8*c* intersects with common feed slot line 8*b*1. The other end of microstrip line 8*c* extends toward one side of substrate 1 and serves as a feed end.

Figure 16:
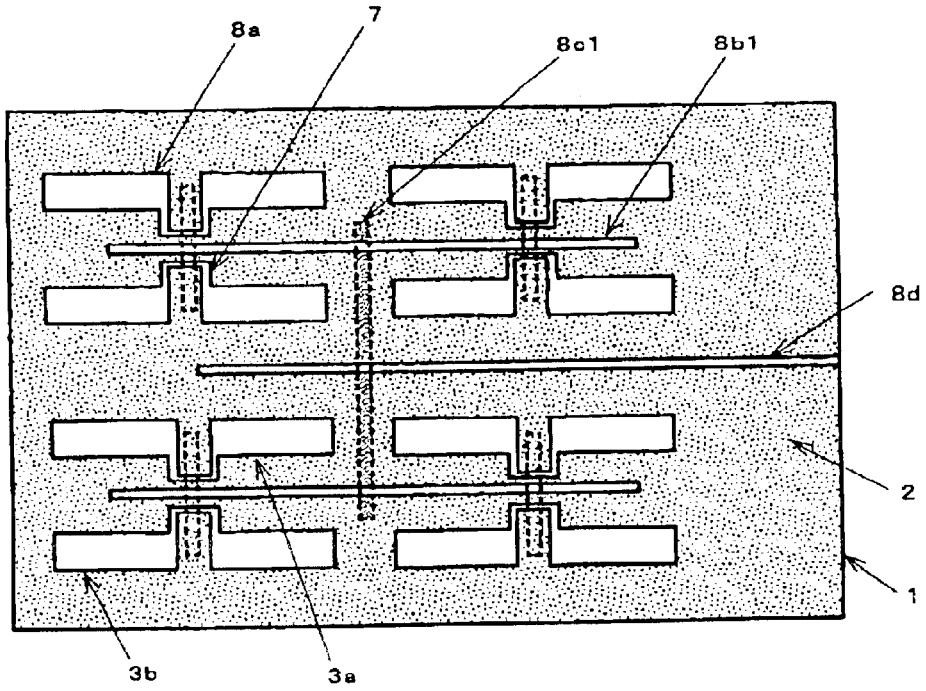
FIG. 16 is a plan view illustrating an eight-element slot line array antenna based on the third embodiment.

FIG. 16 illustrates an eight-element slot line array antenna which comprises a pair of secondary basic units, each of which is the four-element slot line array antenna illustrated in FIG. 15, arranged along an electric field plane. Again, feed microstrip lines in the respective secondary basic units are connected to each other at their respective feed end sides to constitute second common feed microstrip line 8*c*1. Then, feed slot line 8*d* is routed on one main surface of substrate 1 such that one end thereof extends beyond the midpoint of common feed microstrip line 8*c*1 at which feed slot line 8*d* intersects with common feed microstrip line 8*c*1. The other end of feed slot line 8*d* extends toward one side of substrate 1 and serves as a feed end.

Figure 17:
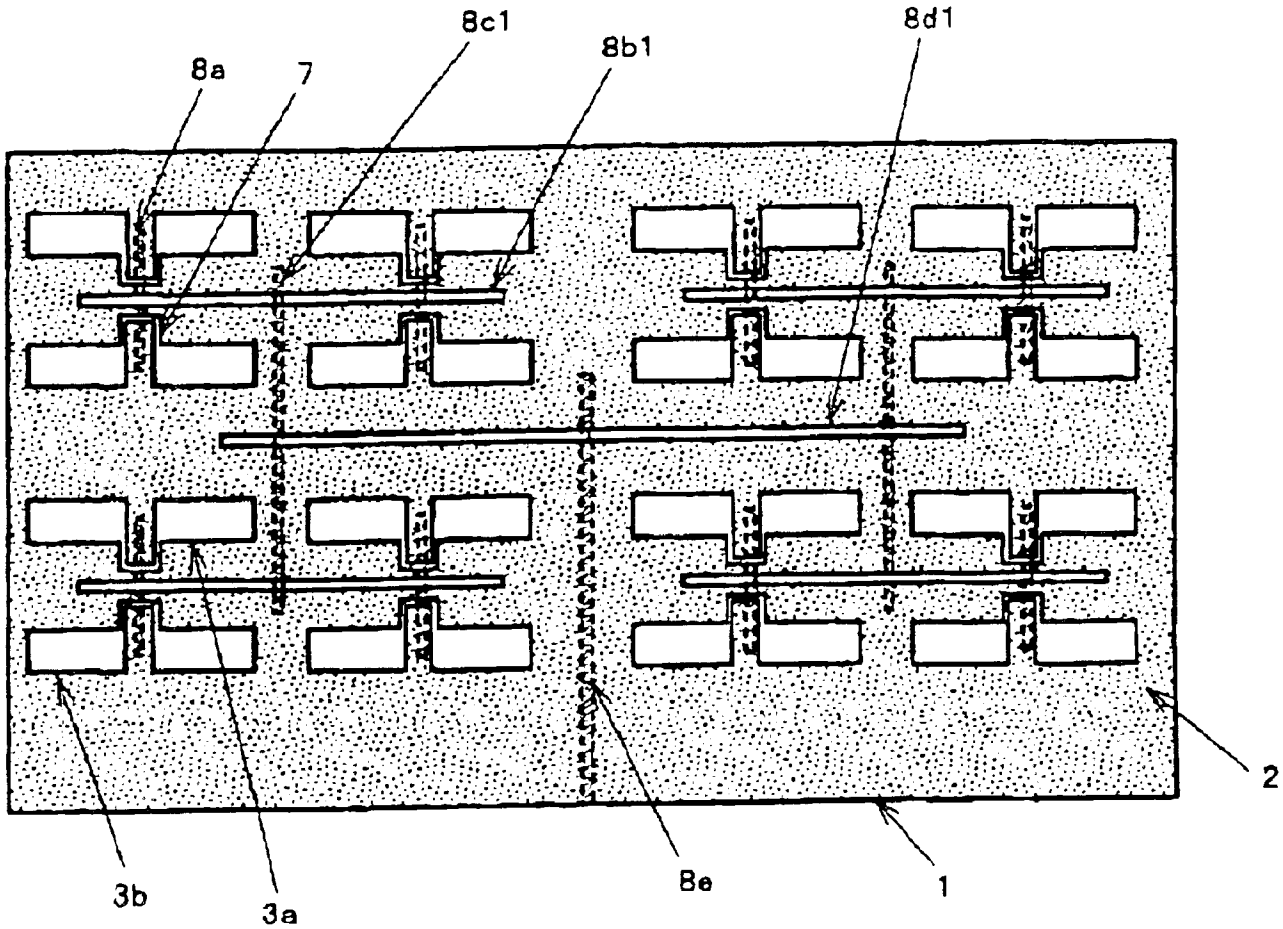
FIG. 17 is a plan view illustrating a 16-element slot line array antenna based on the third embodiment.

FIG. 17 illustrates a 16-element slot line array antenna which comprises a pair of third-order basic units, each of which is the eight-element slot line array antenna illustrated in FIG. 16, arranged along a magnetic field plane. Again, feed slot lines in the respective secondary basic units are connected to each other at their respective feed end sides to constitute second common feed slot line 8*d*1. Then, feed microstrip line 8*e* is routed on the other main surface of substrate 1 such that one end thereof extends beyond the midpoint of common feed slot line 8*d*1 at which feed microstrip line 8*e* intersects with common feed slot line 8*d*1. The other end of microstrip line 8*e* extends toward one side of substrate 1 and serves as a feed end.

As described above, in the planar array antenna according to the third embodiment, four, eight, 16, or a larger number of antenna elements can be excited in phase through a conversion from a microstrip line to a slot line for branching a high frequency signal into two high frequency components in phase having the same amplitude and a conversion from a slot line to a microstrip line for branching a high frequency signal into two high frequency components in opposite phase having the same amplitude, in a manner similar to the planar array antenna according to the first and second embodiments. Further, by arranging the array antenna in mirror symmetry with respect to an electric field plane or a magnetic field plane which starts at the feed end, the array antenna has the same feed length from the feed end to any of the antenna elements and therefore exhibits a good directional characteristic in simple configuration.

Like the antenna arrays according to the first and second embodiments, in the array antenna according to the third embodiment, a pair of the previous order basic units is arranged in parallel along an electric field plane or a magnetic field plane opposite to the direction in which the previous order basic units are arranged, a common feed line is routed such that the previous order basic units are connected to each other at their respective feed end sides, and a further feed line is routed to be electromagnetically coupled to the midpoint of the common feed line. Thus, a resulting multi-element slot line array antenna comprises a number of slot line antenna elements twice as much as those in the previous order slot line array antenna.

Next, description will be made on a slot line array antenna according to a fourth embodiment of the present invention. The antenna element according to the fourth embodiment differs from the array antennas according to the first to third embodiments in that the latter employs linear slot line antenna elements, whereas the former employs a loop-shaped slot line antenna elements. However, the feed system in the fourth embodiment is similar in configuration to the second embodiment.

Figure 18A:
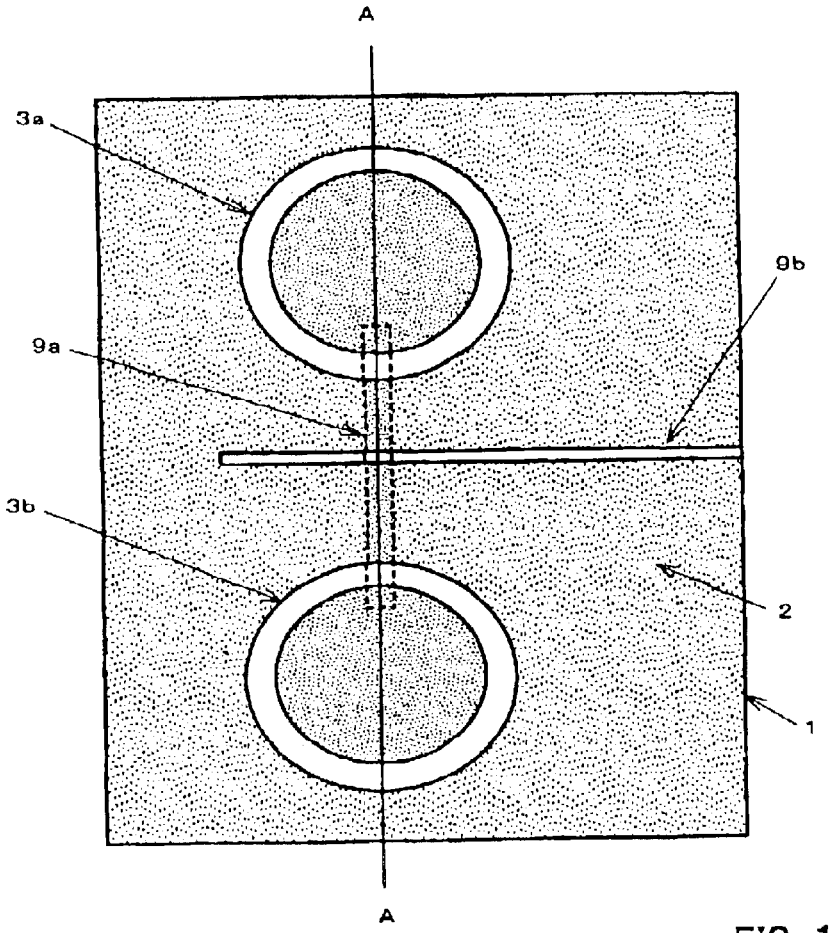
FIG. 18A is a plan view illustrating a two-element slot line array antenna according to a fourth embodiment of the present invention.
Figure 18B:
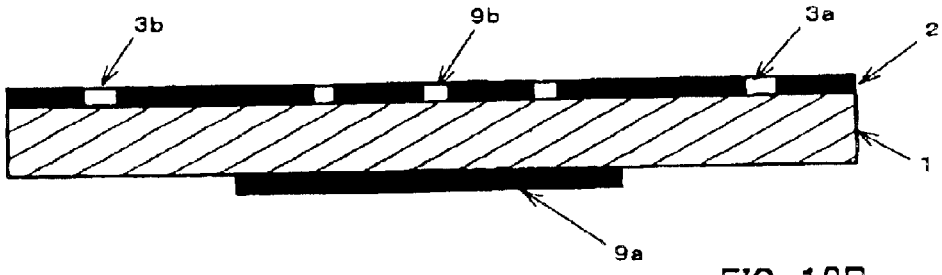
FIG. 18B is a cross-sectional view taken along a line A—A in FIG. 18A.

A two-element slot line array antenna illustrated in FIGS. 18A and 18B, according to the fourth embodiment, has conductor 2 formed substantially over the entirety of one main surface of substrate 1 made of a dielectric material or the like, and conductor 2 is formed with a pair of slot line antenna elements 3*a*, 3*b* each comprised of a loop-shaped slot line. In the illustrated example, the slot line of the antenna element is formed along a circumference, and conductor 2 is left within the circumference. Feed microstrip line 9*a* is formed on the other main surface of substrate 1 with both ends electromagnetically coupled to antenna elements 3*a*, 3*b*, respectively, through substrate 1. Microstrip line 9*a* is provided to connect between the two points on antenna elements 3*a*, 3*b* which are nearest from each other. Feed slot line 9*b* is also formed on the one main surface of substrate 1 such that one end thereof extends beyond the midpoint of microstrip line 9*a* at which feed slot line 9*b* intersects with microstrip line 9*a*. The other end of slot line 9*b* extends toward one side of substrate 1, and serves as a feed end. Microstrip line 9*a* and slot line 9*b* constitute a feed system for antenna elements 3*a*, 3*b*.

In the slot line array antenna as described above, a pair of loop-shaped antenna elements 3*a*, 3*b* are arranged on both sides of feed slot line 9*b*, i.e., along an electric field plane of slot line 9*b*. Like the antenna array according to the second embodiment, antenna elements 3*a*, 3*b* are arranged in mirror symmetry with respect to a magnetic field plane which starts at the feed end in the array antenna illustrated in FIGS. 18A and 18B, so that respective antenna elements 3*a*, 3*b* are excited in phase, and the array antenna has the same feed length from the feed end to any of antenna elements 3*a*, 3*b*.

Figure 19:
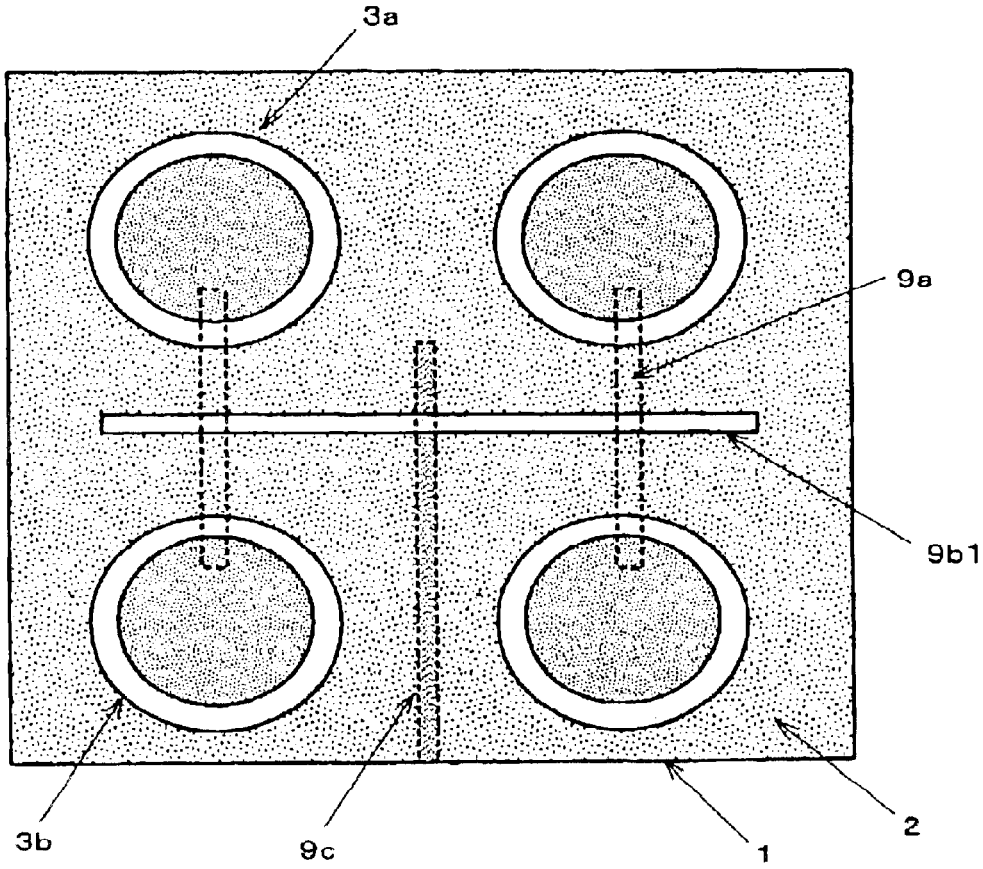
FIG. 19 is a plan view illustrating a four-element slot line array antenna based on the fourth embodiment.

FIG. 19 illustrates a four-element slot line array antenna which comprises a pair of primary basic units, each of which is the two-element slot line array antenna illustrated in FIGS.

18A and 18B, arranged along a magnetic field plane. Common feed slot line 9b1 is formed such that the feed slot lines of the respective basic units are connected to each other at their respective feed end sides. Then, feed microstrip line 9c is provided on the other main surface of substrate 1 such that one end thereof extends beyond the midpoint of common fed slot line 9b1 at which feed microstrip line 9c intersects with common fed slot line 9b1. The other end of microstrip line 9c extends toward one side of substrate 1, and serves as a feed end. This array antenna is arranged in mirror symmetry with respect to an electric field plane which starts at the feed end of feed microstrip line 9c. The antenna elements are excited in phase, and the array antenna has the same feed length from the feed end to any of the antenna elements.

While the two-element and four-element slot array antennas have been shown above, multi-element slot line array antennas having eight, 16, and a larger number of loop-shaped slot line antenna elements can also be provided in the fourth embodiment, in a manner similar to the aforementioned embodiments.

Next, description will be made on a slot line array antenna according to a fifth embodiment of the present invention. While the array antenna according to the fifth embodiment is substantially similar in configuration to the fourth embodiment, the former differs from the latter in that each slot line antenna is formed with a feed region, as is the case with the array antenna according to the third embodiment.

Figure 20A:
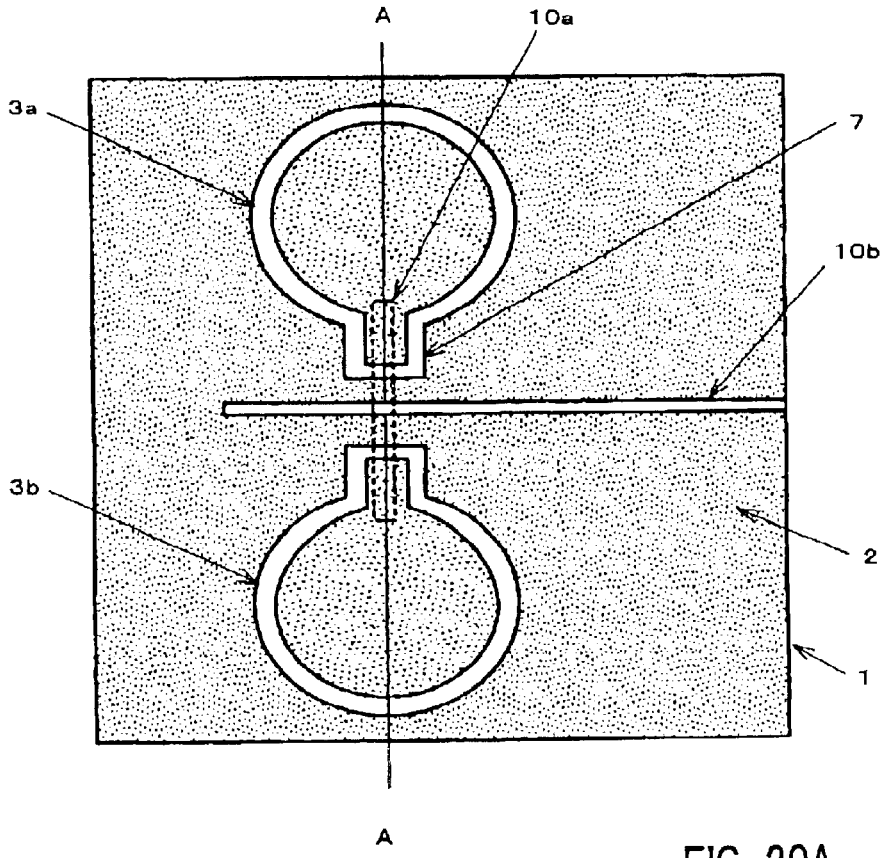
FIG. 20A is a plan view illustrating a two-element slot line array antenna according to a fifth embodiment of the present invention.
Figure 20B:
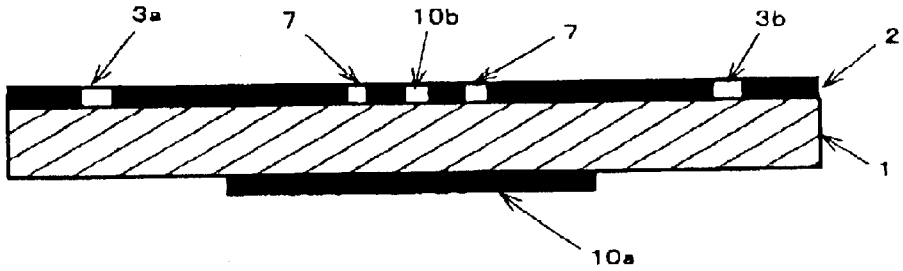
FIG. 20B is a cross-sectional view taken along a line A—A in FIG. 20A.

FIGS. 20A and 20B illustrate a two-element slot line array antenna according to the fifth embodiment. Conductor 2 is disposed on one main surface of substrate 1 made of a dielectric material or the like, and a pair of loop-shaped slot line antenna elements 3a, 3b is formed in conductor 2. Antenna elements 3a, 3b are formed with feed regions 7 each comprised of a coplanar line at locations nearest to each other, in a manner similar to the third embodiment. A feed microstrip line 10a is formed on the other main surface of substrate 1 to be electromagnetically coupled to feed regions 7 on both end sides, respectively. Further, feed slot line 10b is formed on the one main surface of substrate 1 such that one end thereof extends beyond the midpoint of common microstrip line 10a at which feed slot line 10b intersects with common microstrip line 10a. The other end of slot line 10b extends toward one side of substrate 1, and serves as a feed end. Microstrip line 10a and slot line 10b constitute a feed system for antenna elements 3a, 3b.

In the slot line array antenna as described above, a pair of loop-shaped antenna elements 3a, 3b is arranged on both sides of feed slot line 10b, i.e., along an electric field plane of slot line 10b. Like the antenna array according to the third embodiment, the array antenna illustrated in FIGS. 20A and 20B is arranged in mirror symmetry with respect to a magnetic field plane which starts at the feed end, so that respective antenna elements 3a, 3b are excited in phase, and the array antenna has the same feed length from the feed end to any of antenna elements 3a, 3b.

Figure 21:
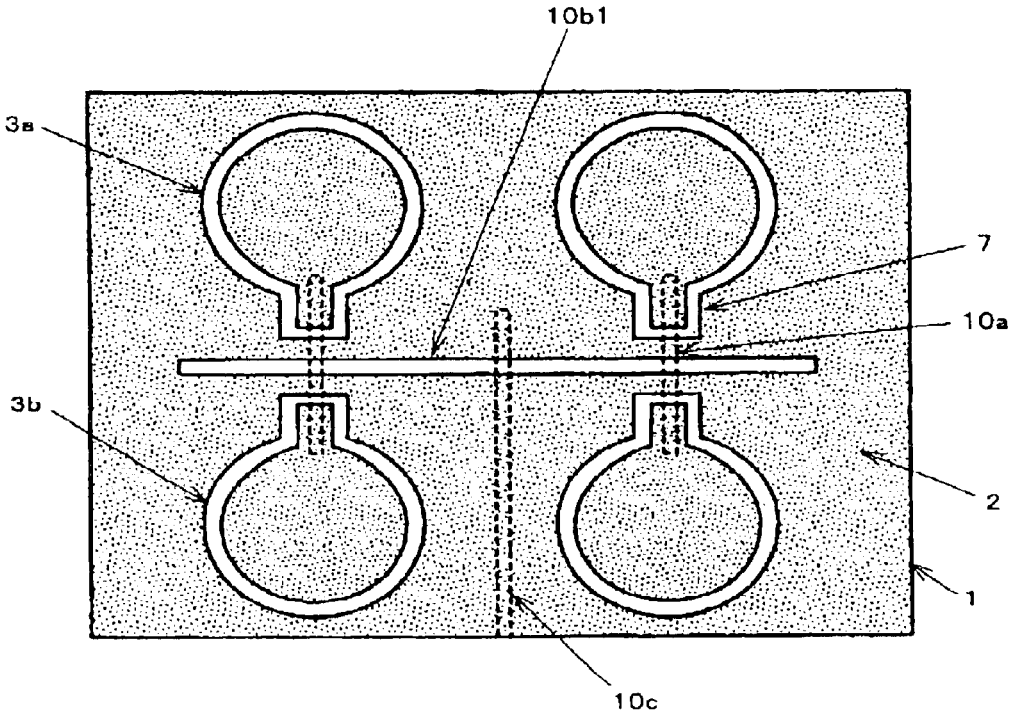
FIG. 21 is a plan view illustrating a four-element slot line array antenna based on the fifth embodiment.

FIG. 21 illustrates a four-element slot line array antenna which comprises a pair of primary basic units, each of which is the two-element slot line array antenna illustrated in FIGS. 20A and 20B, arranged along a magnetic field plane. Common feed slot line 10b1 is formed such that the feed slot lines of the respective basic units are connected to each other at their respective feed end sides. Then, feed microstrip line 10c is routed on the other main surface of substrate 1 such that one end thereof extends beyond the midpoint of common feed slot line 10b1 at which feed microstrip line 10c intersects with common feed slot line 10b1. The other end of microstrip line 10c extends toward one side of substrate 1, and serves as a feed end. This array antenna are arranged in mirror symmetry with respect to an electric field plane which starts at the feed end of feed microstrip line 10c. The antenna elements are excited in phase, and the array antenna has the same feed length from the feed end to any of the antenna elements.

While the two-element and four-element slot array antennas have been shown above, multi-element slot line array antennas having eight, 16, and a larger number of loop-shaped slot line antenna elements can also be provided in the fourth embodiment, in a manner similar to the aforementioned embodiments.

In the fourth and fifth embodiments described above, the shape of the loop-shaped slot line antennas is not limited to a circle, but the circular slot line antenna element can be replaced with a slot line antenna element which circumvents along a rectangle, or with a slot line antenna element which circumvents along an ellipse. Such antenna elements are similar in basic operation to the circular slot line antenna elements.

Figure 22A:
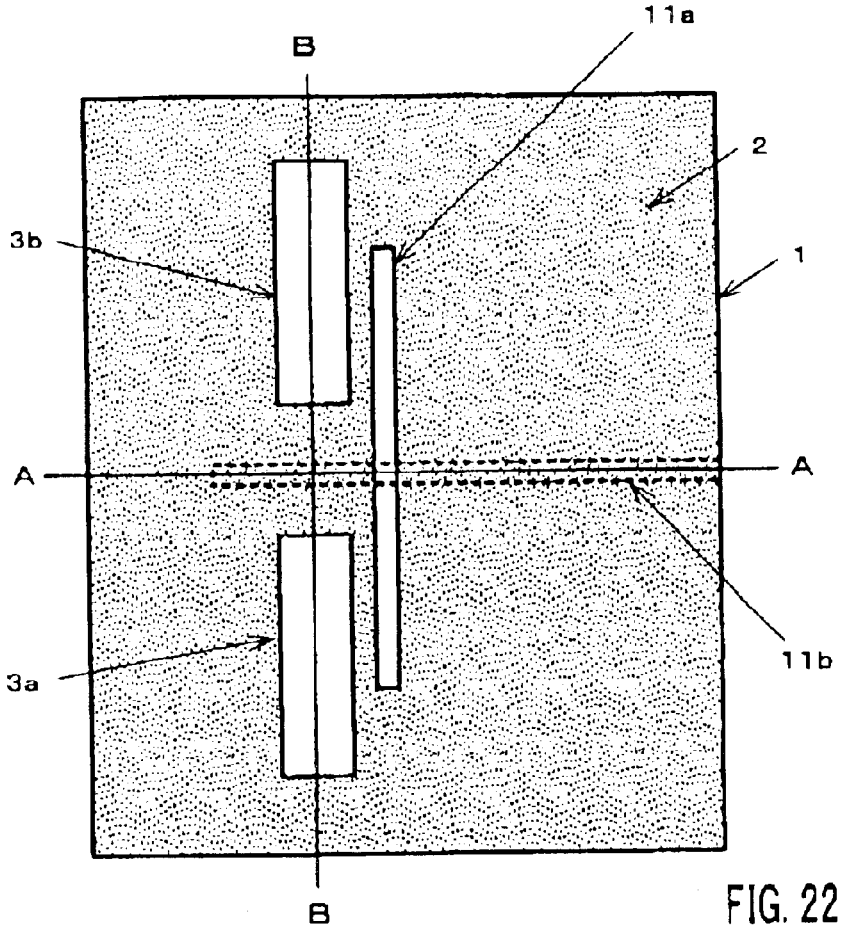
FIG. 22A is a plan view illustrating a two-element slot line array antenna according to a sixth embodiment of the present invention.
Figure 22B:
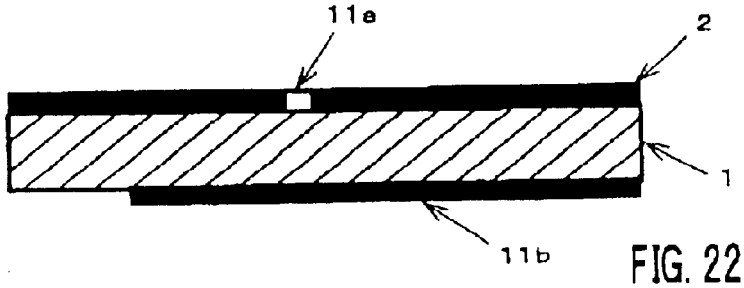
FIG. 22B is a cross-sectional view taken along a line A—A in FIG. 22A.

Next, description will be made on a slot line array antenna according to a sixth embodiment of the present invention. An array antenna according to the sixth embodiment differs from the array antenna according to each of the first to fifth embodiments in that the latter has a pair of antenna elements arranged along an electric field direction, whereas the former has a pair of antenna elements arranged in a magnetic field direction. FIGS. 22A and 22B illustrate a two-element slot line array antenna according to the sixth embodiment.

In the slot line array antenna illustrated in FIGS. 22A and 22B, conductor 2 is disposed on one main surface of substrate 1 made of a dielectric material or the like. A pair of linear slot line antenna elements 3a, 3b are arranged end to end in the longitudinal direction in conductor 2. Feed slot line 11a is routed on the one main surface of substrate 1 in close proximity to one side of slot line antenna elements 3a, 3b in the width direction of antenna elements 3a, 3b arranged end to end, and in parallel with the longitudinal direction of antenna elements 3a, 3b. Thus, antenna elements 3a, 3b are arranged along a magnetic field plane. A feed microstrip line 11b is routed on the other main surface of substrate 1 such that one end thereof extends beyond the midpoint of slot line 11a at which feed microstrip line 11b intersects with slot line 11a. The other end of microstrip line 11b extends toward one side of substrate 1, and serves as a feed end. Feed slot line 11a and feed microstrip line 11b constitute a feed system for antenna elements 3a, 3b.

Feed slot line 11a has a finite length with both short-circuit ends. Feed slot line 11a overlaps a pair of slot line antenna elements 3a, 3b on both end sides from each one end side to a central region by an equal distance. One end of feed microstrip line 11b extends by $\lambda/4$ from the midpoint of first feed slot line 11a, and is electrically short-circuited, where $\lambda$ is a wavelength corresponding to an operating frequency of the antenna.

In the configuration as described above, a high frequency signal from feed microstrip line 11b is branched from the midpoint of feed slot line 11a into two high frequency components in phase having the same amplitude which propagate toward both ends of slot line 11a. Each of the branched high frequency components is immediately fed to the pair of slot line antenna elements 3a, 3b in phase through electromagnetic coupling therewith. Antenna elements 3a, 3b thus electromagnetically radiate the high frequency signals.

Again, since the array antenna is arranged in mirror symmetry with respect to the magnetic field plane which starts at the feed end of feed microstrip line 11*b*, the array antenna has the same feed length from the feed end to each of antenna elements 3*a*, 3*b*, and can excite antenna elements 3*a*, 3*b* in phase without phase shift.

Each of slot line antenna elements 3*a*, 3*b* overlaps feed slot line 11*a* from one end side to a central region by the same distance. As a result, a stronger electric field is produced near both opposing ends of the pair of slot line antenna elements 3*a*, 3*b*, so that an electric field distribution of the overall array antenna is represented by a curve having a single peak with a maximum located at the midpoint of the pair of slot line antenna elements 3*a*, 3*b*. According to a feeding method in the sixth embodiment, while each of slot line antenna elements 3*a*, 3*b* produces an offset on the magnetic field plane, a combined directivity of both antenna elements represented by a curve having a single peak as a whole because the antenna elements are arranged in mirror symmetry with respect to the electric field plane.

Figure 22C:
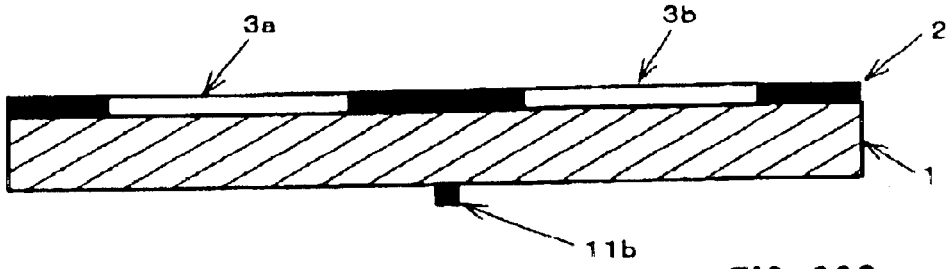
FIG. 22C is a cross-sectional view taken along a line B—B in FIG. 22A.

As is apparent from the structure illustrated in FIGS. 22A to 22C, this array antenna can satisfactorily suppress orthogonal components because there is no feed line which causes the orthogonal components. Since slot line antenna elements 3*a*, 3*b* are excited in mirror symmetry with respect to the electric field plane, a directivity offset can also be effectively suppressed on the magnetic field plane. It should be noted that these advantages can be provided in the aforementioned embodiments as well.

Figure 23:
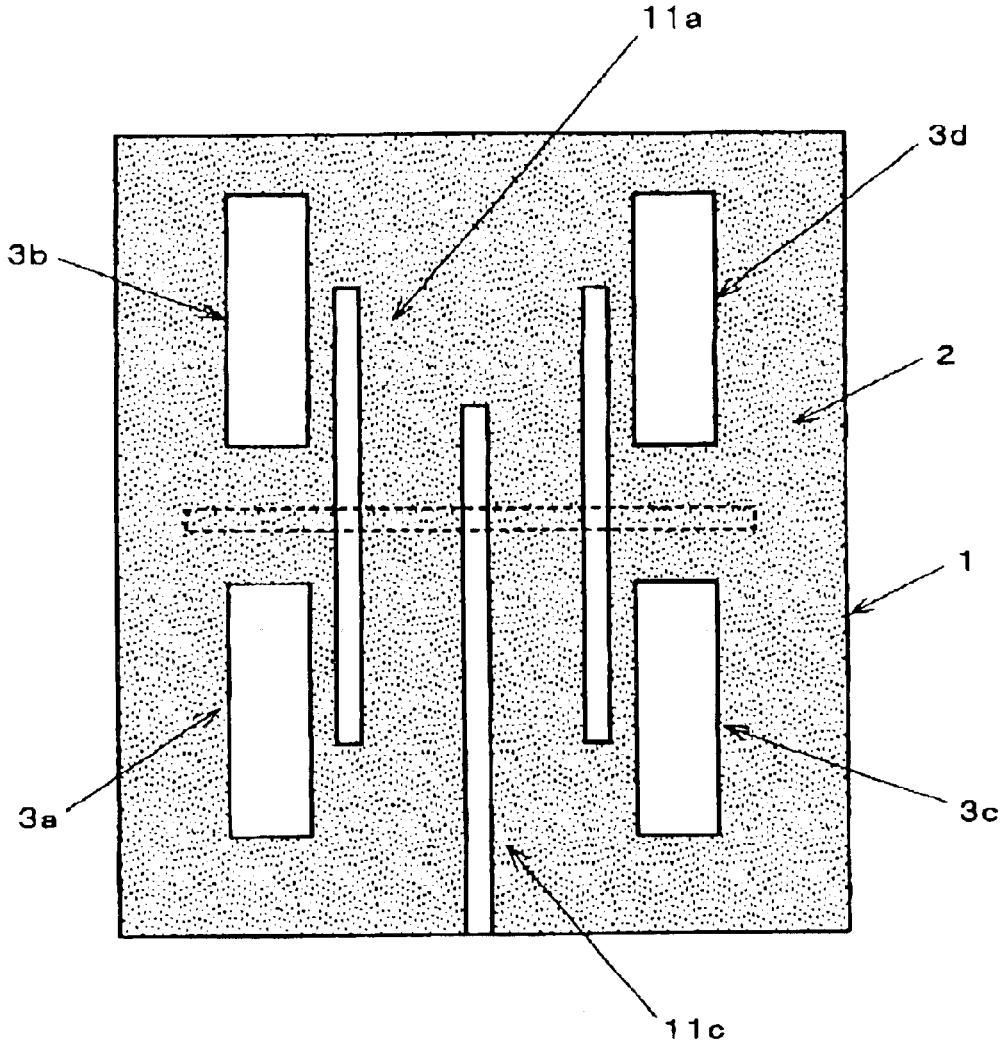
FIG. 23 is a plan view illustrating a four-element slot line array antenna based on the sixth embodiment.

FIG. 23 illustrates a four-element slot line array antenna which comprises a pair of primary basic units, each of which is the two-element slot line array antenna illustrated in FIGS. 22A to 22C, arranged in mirror symmetry along a magnetic field plane orthogonal to the direction in which slot line antenna elements 3*a*, 3*b* are arranged. Common feed microstrip line 11*b*1 is formed such that the feed microstrip lines of the respective basic units are connected to each other at their respective feed end sides. Feed slot line 11*c* is formed on one main surface of substrate 1 such that one end extends beyond the midpoint of common feed microstrip line 11*b*1 at which feed slot line 11*c* intersects with common feed microstrip line 11*b*1. The one end of slot line 11*c* is electrically opened, while the other end extends toward one side of substrate 1, and serves as a feed end. The four antenna elements of the slot line array antenna are arranged in mirror symmetry with respect to the magnetic field plane which starts at the feed end of feed slot line 11*c*.

In the configuration as described above, a high frequency signal from feed slot line 11*c* is branched from the midpoint of common feed microstrip line 11*b*1 into two high frequency components in opposite phase having the same amplitude which excite the slot line antenna elements associated therewith in phase on both end sides of common feed slot line 11*b*1. Again, since the array antenna is arranged in mirror symmetry with respect to the magnetic field plane which starts at the feed end of feed slot line 11*c*, the array antenna has the same feed length from the feed end to each of slot line antenna elements 3*a*, 3*b*, and exhibits a good directivity in simple configuration.

Likewise, in the sixth embodiment, a pair of the previous order basic units is arranged in parallel along an electric field plane or a magnetic field plane, a common feed line is routed such that the previous order basic units are connected to each other at their respective feed end sides. A slot line is routed on the one main surface of the substrate corresponding to the midpoint of the common feed line when the common feed line is a microstrip line, or a microstrip line is routed on the other main surface of the substrate corresponding to the midpoint of the common feed line when the common feed line is a slot line. Thus, a resulting multi-element slot line array antenna comprises a number of slot line antenna elements twice as much as those in the previous order slot line array antenna. Specifically, the resulting multi-element slot line array antenna has eight, 16, 32 or a larger number of antenna elements.

Next, description will be made on a slot line array antenna according to a seventh embodiment of the present invention. A two-element slot line array antenna according to the seventh embodiment is similar to the sixth embodiment in that a pair of slot line antenna elements is arranged along a magnetic field plane, but differs from the sixth embodiment in the configuration of a feed system.

Figure 24A:
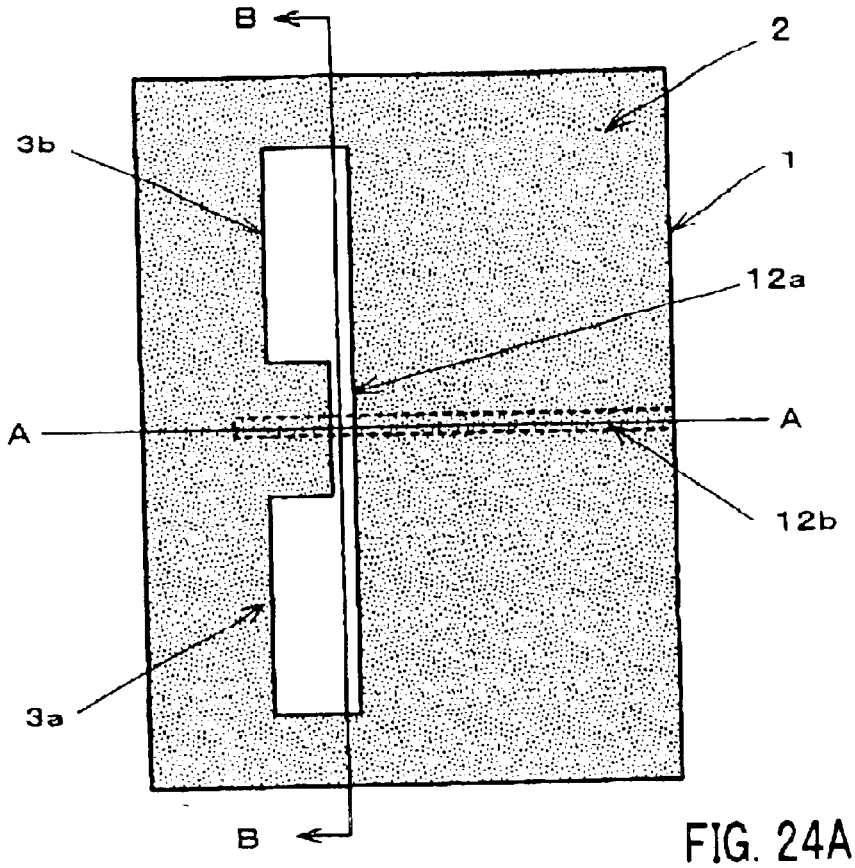
FIG. 24A is a plan view describing a two-element slot line array antenna according to a seventh embodiment of the present invention.
Figure 24B:
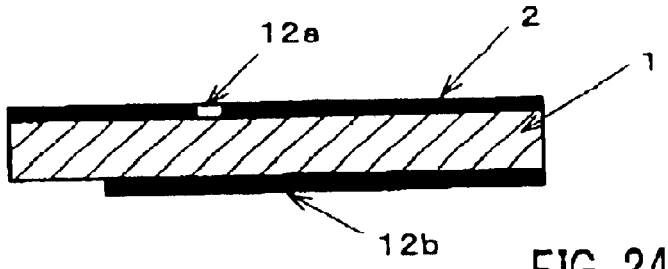
FIG. 24B is a cross-sectional view taken along a line A—A in FIG. 24A.
Figure 24C:
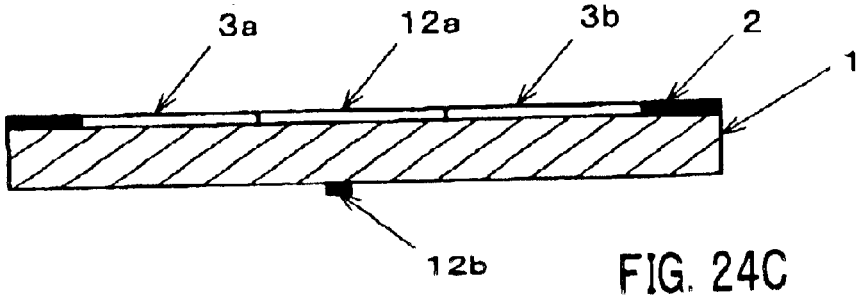
FIG. 24C is a cross-sectional view taken along a line B—B in FIG. 24A.

Specifically, in the two-element slot line array antenna illustrated in FIGS. 24A to 24*c*, according to the seventh embodiment, conductor 2 is disposed on one main surface of substrate 1 made of a dielectric material or the like. A pair of linear slot line antenna elements 3*a*, 3*b* are arranged end to end in the longitudinal direction in conductor 2. Feed slot line 12*a* is formed on the one main surface of substrate 1 along one side of each slot line antenna element 3*a*, 3*b* in the width direction to connect corners of antenna elements 3*a*, 3*b* to each other. A feed microstrip line 12*b* is routed on the other main surface of substrate 1 such that one end extends beyond the midpoint of feed slot line 12*a* at which feed microstrip line 12*b* intersects with feed slot line 12*a*. The one end of microstrip line 12*b* is electrically short-circuited. The other end of microstrip line 12*b* extends toward one side of substrate 1, and serves as a feed end. Feed slot line 12*a* and feed microstrip line 12*b* constitute a feed system for antenna elements 3*a*, 3*b*.

In this configuration, a pair of slot line antenna elements 3*a*, 3*b* are arranged along a magnetic field direction of feed slot line 12*a*, and slot line 12*a* is coupled to antenna elements 3*a*, 3*b* in the magnetic field direction.

In the configuration as described above, a high frequency signal from feed microstrip line 12*b* is branched at the midpoint of feed slot line 12*a* into two high frequency components in phase having the same amplitude, and are fed to the pair of slot line antenna elements 3*a*, 3*b* connected to feed slot line 12*a* in phase. As a result, antenna elements 3*a*, 3*b* are excited in phase to electromagnetically radiate high frequency signals.

Again, since the array antenna is arranged in mirror symmetry with respect to the magnetic field plane which starts at the feed end of feed microstrip line 12*b*, the array antenna has the same feed length from the feed end to each antenna element 3*a*, 3*b*, and can excite these antenna elements 3*a*, 3*b* in phase without phase shift.

Figure 25:
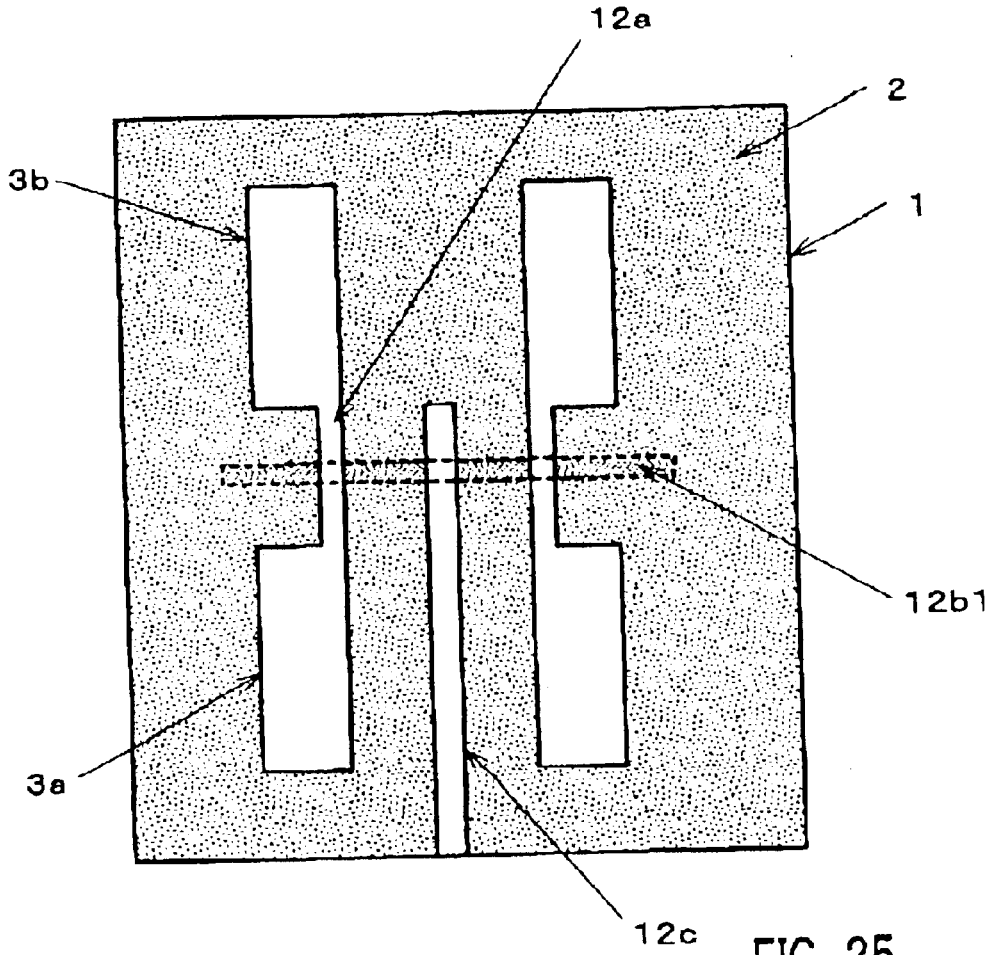
FIG. 25 is a plan view illustrating a four-element slot line array antenna according to the seventh embodiment.

FIG. 25 illustrates a four-element slot line array antenna which comprises a pair of primary basic units, each of which is the two-element slot line array antenna illustrated in FIGS. 24A to 24C, arranged in mirror symmetry along an electric field plane orthogonal to the direction in which slot line antenna elements 3*a*, 3*b* are arranged. Common feed microstrip line 12*b*1 is formed such that the feed microstrip lines of the respective basic units are connected to each other at their respective feed end sides. Feed slot line 12*c* is formed on one main surface of substrate 1 such that one end extends beyond the midpoint of common feed microstrip line 12*b*1 at which feed slot line 12*c* intersects with common feed microstrip line 12*b*1. The one end of slot line 12*c* is electrically opened, while the other end extends toward one side of substrate 1, and serves as a feed end. The four-element slot line array antenna is arranged in mirror symmetry with respect to the magnetic field plane which starts at the feed end of feed slot line 12*c*. Further, as is the case with the foregoing embodiments, the four-element slot line array antennas thus configured can be combined to form a multi-element slot line array antenna which has eight, 16, 32, or a larger number of antenna elements.

In the array antenna illustrated in the seventh embodiment, while each of slot line antenna elements 3*a*, 3*b* produces a directivity offset on the electric field plane, the four-element slot line array antenna illustrated in FIG. 25 can eliminate the electric field plane directivity offset because the antenna elements are fed in a mirror symmetry manner to each other on the electric field plane. It should be noted that the elimination of electric field directivity offset is an advantage of the four-element slot line array antennas in the foregoing embodiments described above.

Figure 26A:
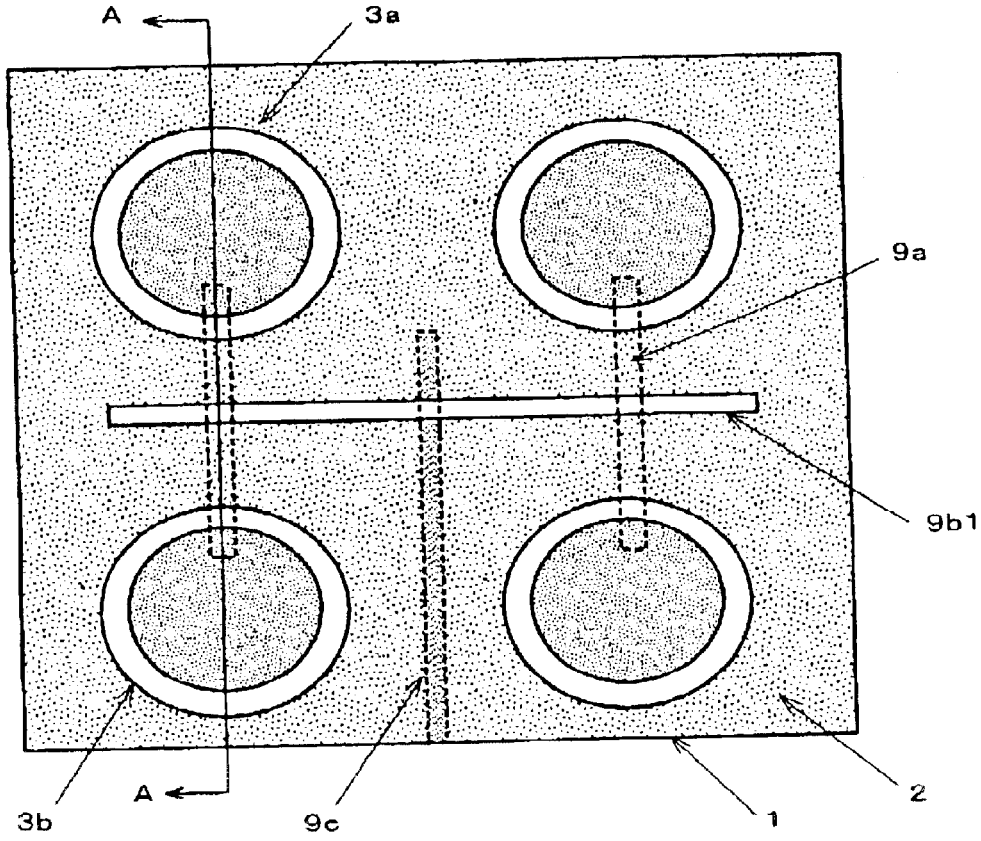
FIG. 26A is a diagram illustrating a four-element slot line array antenna according to another embodiment of the present invention.
Figure 26B:
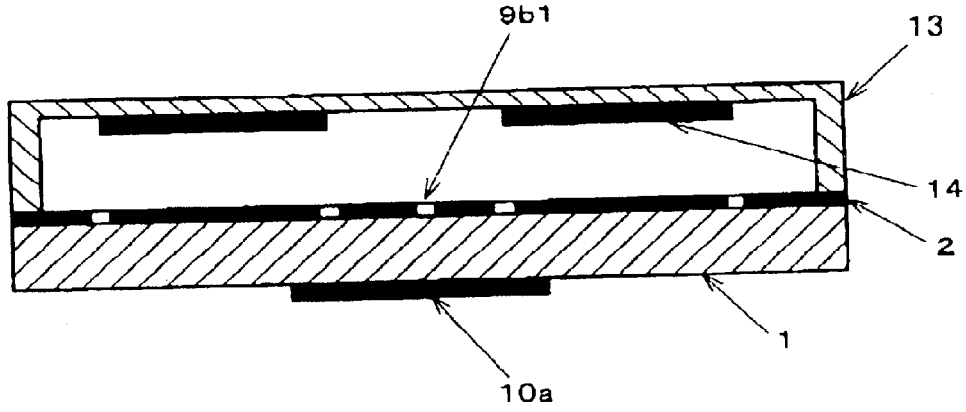
FIG. 26B is a cross-sectional view taken along a line A—A in FIG. 26A.

Next, description will be made on another embodiment of the present invention. The array antenna of the present invention can further improve the antenna gain by arranging a conductor in correspondence to each antenna element on an electromagnetic wave radiation surface such that the conductor is spaced away from each antenna element and opposes each antenna element. FIGS. 26A and 26B illustrate the configuration of an antenna having such conductors, wherein conductive layer 14 is provided above one main surface of substrate 1, i.e., an electromagnetic wave radiation surface, opposite to each antenna element in the four-element slot line array antenna illustrated in FIG. 19. Conductive layers 14 are disposed on the bottom of holder package 13 made, for example, of a dielectric material and having an open face. Holder package 13 is mounted on substrate 1 such that the open face is in contact with the one main surface of substrate 1. FIG. 26A illustrates the configuration of the array antenna when holder package 13 is removed.

In the slot line array antenna as described above, conductive layer 14 disposed above each antenna element functions as a non-feed antenna which is loaded over each antenna element and acts as a space resonance system. An inductive current flowing through each conductive layer 14 improves the antenna gain of the array antenna.

While conductive layers 14 are disposed on the inner surface, i.e., a recessed bottom of holder package 13, they may be disposed on the outer surface of the holder package. Means for holding conductive layers 14 above the antenna elements is not limited to the holder package. For example, a second substrate may be provided with conductive layers 14 formed on one main surface thereof as non-feed antennas, and laminated on the one main surface of substrate 1. Alternatively, a plurality of conductive layers 14 may be stacked at predetermined intervals above respective antenna elements to improve the antenna gain.

The conductors disposed above the antenna elements to function as non-feed antennas can be applied to any of the slot line array antennas according to the respective embodiments described above.

What is claimed is:

1. A slot line array antenna comprising:

a substrate having a first and a second main surface;

a conductor disposed on the first main surface;

a slot line formed in said conductor;

a pair of slot line antenna elements formed in said conductor; and a feed system disposed on said substrate, and having a feed end for feeding said pair of antenna elements, wherein:

said feed system includes said slot line;

said pair of antenna elements are arranged in parallel with an electric field plane or a magnetic field plane formed by said slot line; and said pair of antenna elements and said feed system are arranged in mirror symmetry with respect to a magnetic field plane or electric field plane which starts at said feed end, such that said pair of antenna elements are excited in phase.

2. The slot line array antenna according to claim 1, wherein said pair of antenna elements are electromagnetically coupled to said feed system independently of each other.

3. The slot line array antenna according to claim 1, wherein said antenna elements are arranged along said electric field plane.

4. The slot line array antenna according to claim 3, wherein said slot line is routed in parallel with a direction in which said antenna elements extend at an intermediate position of said pair of antenna elements, said slot line having one end side electromagnetically coupled to said pair of antenna elements and the other end side serving as said feed end.

5. The slot line array antenna according to claim 3, wherein:

said feed system includes a microstrip line routed on the second main surface, said microstrip line having both end portions electromagnetically coupled to said pair of antenna elements, respectively, and said slot line has one end side formed as an electrically open end and intersecting with said microstrip line at a midpoint of said microstrip line, and the other end side serving as said feed end.

6. The slot line array antenna according to claim 5, wherein said pair of antenna elements each comprise a linear slot line.

7. The slot line array antenna according to claim 5, wherein said pair of antenna elements each comprises a slot line formed in a loop shape.

8. The slot line array antenna according to claim 3, wherein:

said feed system includes:

a feed region comprised of a coplanar line, disposed on the first main surface for each of said antenna elements and connected to said each antenna element; and a microstrip line routed on the second main surface and having both end portions electromagnetically coupled to said feed regions, respectively, and said slot line has one end side formed as an electrically open end and intersecting with said microstrip line at a midpoint of said microstrip line, and the other end side serving as said feed end.

9. The slot line array antenna according to claim 8, wherein said pair of antenna elements each comprises a linear slot line.

10. The slot line array antenna according to claim 8, wherein said pair of antenna elements each comprise a slot line formed in a loop shape.

11. The slot line array antenna according to claim 1, wherein said antenna elements are arranged along said magnetic field plane.

12. The slot line array antenna according to claim 11, wherein:

said feed system has a microstrip line routed on the second main surface, said microstrip line having one end side formed as an electrically short-circuited end and intersecting with said slot line at a midpoint of said slot line, and the other end side serving as said feed end; and said slot line is routed in parallel with a direction in which said pair of antenna elements are arranged, and said slot line has both end sides electromagnetically coupled to said pair of antenna elements, respectively.

13. The slot line array antenna according to claim 11, wherein:

said feed system has a microstrip line routed on the second main surface, said microstrip line having one end side formed as an electrically open end and intersecting with said slot line at a midpoint of said slot line, and the other end side serving as said feed end; and said slot line connects said pair of antenna elements to each other in a magnetic field direction.

14. A multi-element slot line array antenna comprising:

a pair of primary basic units, each of which is said slot line array antenna according to claim 1, arranged in mirror symmetry to each other in a direction orthogonal to a direction in which said pair of antenna elements are arranged;

a common feed line for connecting said feed systems of said respective primary units to each other at respective feed end sides thereof; and a feed line having one end side electromagnetically coupled to said common feed line at a midpoint thereof and the other end side serving as a feed end, wherein said antenna elements are excited in phase.

15. The multi-element slot line array antenna according to claim 14, wherein said feed line comprises a slot line when said common feed line comprises a microstrip line, and said feed line comprises a microstrip line when said common feed line comprises a slot line.

16. A multi-element slot line array antenna, wherein said multi-element slot line array antenna according to claim 14 constitutes a secondary basic unit, said array antenna comprising:

a pair of $n^{th}$ order basic units arranged in a direction orthogonal to a direction in which $(n-1)^{th}$ order basic units are arranged in said $n^{th}$ basic units such that said $n^{th}$ order basic units are in mirror symmetry to each other;

a common feed line formed to connect said feed systems of said respective $n^{th}$ order basic units to each other at the respective feed end sides thereof; and a feed line having one end side coupled to said common feed line at a midpoint thereof and the other end side serving as a feed end, wherein said antenna elements are excited in phase.

17. The multi-element slot line array antenna according to claim 16, wherein said feed line is formed in a slot line structure when said common feed line has a microstrip line structure, and said feed line is formed in a microstrip line structure when said common feed line has a slot line structure.

18. The multi-element slot line array antenna according to claim 16, wherein said pair of antenna elements included in each said primary basic unit are arranged along an electric field plane.

19. The multi-element slot line array antenna according to claim 18, wherein said slot line is routed in parallel with a direction in which said antenna elements extend at an intermediate position of said pair of antenna elements, said slot line having one end side electromagnetically coupled to said pair of antenna elements and the other end side serving as said feed end.

20. The multi-element slot line array antenna according to claim 18, wherein:

said feed system includes a microstrip line routed on the second main surface, said microstrip line having both end sides electromagnetically coupled to said pair of antenna elements, and said slot line has one end side formed as an electrically open end and intersecting with said microstrip line at a midpoint of said microstrip line, and the other end side serving as said feed end.

21. The multi-element slot line array antenna according to claim 18, wherein:

said feed system includes:

a feed region comprised of a coplanar line disposed on the main surface for each of said antenna elements and connected to said each antenna element; and a microstrip line routed on the second main surface and having both end portions electromagnetically coupled to said feed regions, respectively, and said slot line has one end side formed as an electrically open end and intersecting with said microstrip line at a midpoint of said microstrip line, and the other end side serving as said feed end.

22. The multi-element slot line array antenna according to claim 16, wherein said pair of antenna elements included in said each primary basic unit are arranged along a magnetic field plane.

23. The multi-element slot line array antenna according to claim 22, wherein:

said feed system has a microstrip line routed on the second main surface, said microstrip line having one end side formed as an electrically short-circuited end and intersecting with said slot line at a midpoint of said slot line, and the other end side serving as said feed end; and said slot line is routed in parallel with the direction in which said pair of antenna elements are arranged, and said slot line has both end sides electromagnetically coupled to said pair of antenna elements, respectively.

24. The multi-element slot line array antenna according to claim 11, wherein:

said feed system has a microstrip line routed on the second main surface, said microstrip line having one end side formed as an electrically short-circuited end and intersecting with said slot line at a midpoint of said slot line, and the other end side serving as said feed end; and said slot line connects said pair of antenna elements to each other in a magnetic field direction.

25. The slot line array antenna according to claim 1, further comprising a non-feed antenna loaded over said each antenna element.

* * * * *

UNITED STATES PATENT AND TRADEMARK OFFICE

CERTIFICATE OF CORRECTION

PATENT NO. : 6,825,816 B2
DATED : November 30, 2004
INVENTOR(S) : M. Aikawa et al.

It is certified that error appears in the above-identified patent and that said Letters Patent is hereby corrected as shown below:

Title page,
Line [73], Assignees, should read -- Nihon Dempa Kogyo Co., Ltd., Tokyo (JP); Masayoshi Aikawa, Kanagawa (JP) --

Signed and Sealed this

Nineteenth Day of April, 2005

JON W. DUDAS
*Director of the United States Patent and Trademark Office*